US009122192B2

(12) United States Patent
Yagyu et al.

(10) Patent No.: US 9,122,192 B2
(45) Date of Patent: Sep. 1, 2015

(54) DETECTION DEVICE, DEVELOPING DEVICE AND IMAGE FORMING APPARATUS

(71) Applicant: CANON KABUSHIKI KAISHA, Tokyo (JP)

(72) Inventors: Mineto Yagyu, Hachioji (JP); Shingo Horita, Yokosuka (JP); Masaaki Naoi, Yokosuka (JP); Megumi Uchino, Tokyo (JP); Yoshihiro Shigemura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/515,847

(22) Filed: Oct. 16, 2014

(65) Prior Publication Data

US 2015/0110509 A1 Apr. 23, 2015

(30) Foreign Application Priority Data

Oct. 21, 2013 (JP) ..... 2013-218673

(51) Int. Cl.
*G03G 15/08* (2006.01)
*G03G 15/06* (2006.01)

(52) U.S. Cl.
CPC ..... *G03G 15/065* (2013.01); *G03G 15/0848* (2013.01)

(58) Field of Classification Search
CPC ..... G03G 15/0848
See application file for complete search history.

(56) References Cited

U.S. PATENT DOCUMENTS

| | | | | |
|---|---|---|---|---|
| 5,006,897 | A | 4/1991 | Rimai et al. | |
| 5,285,243 | A * | 2/1994 | Rimai et al. | 399/274 |
| 5,532,802 | A * | 7/1996 | Sonnenberg et al. | 399/58 |
| 7,917,063 | B2 | 3/2011 | Horita et al. | |
| 8,335,441 | B2 | 12/2012 | Kubo et al. | |
| 8,577,235 | B2 | 11/2013 | Matsumoto et al. | |
| 8,611,768 | B2 | 12/2013 | Kubo et al. | |
| 2014/0064749 | A1 | 3/2014 | Kubo et al. | |
| 2014/0314432 | A1 * | 10/2014 | Uchino et al. | 399/49 |
| 2014/0314434 | A1 * | 10/2014 | Shigemura et al. | 399/55 |

FOREIGN PATENT DOCUMENTS

| | | | |
|---|---|---|---|
| JP | 3725195 | B | 12/2005 |
| JP | 2011-179838 | A | 9/2011 |

* cited by examiner

*Primary Examiner* — G. M. Hyder
(74) *Attorney, Agent, or Firm* — Fitzpatrick, Cella, Harper & Scinto

(57) ABSTRACT

A detection device configured to detect a charge amount of toner on a developer carrier includes an assembly with a quartz oscillator and having a first surface and a second surface that are provided in the quartz oscillator. The first surface has a recess and a projection formed in a direction in which the quartz oscillator vibrates. In addition, a capacitor is connected to the assembly, a first measurement unit measures a potential difference between two ends of the capacitor, and a second measurement unit measures a frequency of the quartz oscillator. In a case where an alternating-current power is applied to the assembly, the direction in which the quartz oscillator vibrates is parallel to the first surface.

13 Claims, 15 Drawing Sheets

DETECTION DEVICE, DEVELOPING DEVICE AND IMAGE FORMING APPARATUS

BACKGROUND OF THE INVENTION

1. Field of the Invention

The present invention relates to a detection device, a developing device, and an image forming apparatus, and in particular relates to detection control for detecting toner charge amount.

2. Description of the Related Art

An electrophotographic image forming apparatus forms a toner image by forming an electrostatic latent image on a photoreceptor on the basis of a document read by a reader or an image transmitted from an external PC and developing the electrostatic latent image on the photoreceptor using toner in a developing unit. The image forming apparatus controls the density of the toner image by controlling image forming conditions such as the amount of exposure to a laser beam emitted from an exposure apparatus for forming the electrostatic latent image on the photoreceptor, a developing bias for developing the electrostatic latent image on the photoreceptor, and a charge potential for charging the photoreceptor. However, if the toner is consumed from the developing unit or toner is additionally supplied to the developing unit while a large number of toner images are being formed, the charge amount of the toner in the developing unit will change. Further, the charge amount of the toner in the developing unit changes also due to changes in temperature or humidity inside the developing unit. In order to control the density and color tone of the toner image with high accuracy, it is desired that the image forming conditions are controlled according to the charge amount of the toner in the developing unit.

An apparatus that includes a probe for collecting a very small amount of toner from a magnetic brush roller of a developing unit and is configured to measure the charge amount of toner in the developing unit on the basis of the mass of the toner collected by the probe and the change in the charge amount on the magnetic brush roller has been proposed (see the specification of U.S. Pat. No. 5,006,897).

According to the specification of U.S. Pat. No. 5,006,897, toner on the magnetic brush roller of the developing unit is first adsorbed by a probe provided with a piezoelectric crystal resonator and an electrode, and the piezoelectric crystal resonator is caused to vibrate. The mass M of the toner adhering to the probe is calculated based on the difference between a vibration frequency in the state where the toner is adhering to the probe and a vibration frequency in the state where no toner is adhering to the probe. Further, since the toner is moved from the magnetic brush roller to the probe, the charge amount Q of the toner adhering to the probe can be determined by measuring the change in the charge amount of the toner on the magnetic brush roller. The charge amount of toner in the developing unit can be detected on the basis of the mass M and the charge amount Q of the toner adhering to the probe.

However, it has been experimentally proven that the vibration frequency in the state where the toner is adhering to the probe is actually the same as the vibration frequency in the state where no toner is adhering to the probe, and thus the mass M of the toner adhering to the probe cannot be detected.

One possible reason for this is that the toner that is to be detected slides off due to the vibration of a QCM sensor. For example, the mass detection surface of the probe is subjected to shear vibration at a resonance frequency of several [MHZ] to 10 [MHz]. The vibration direction is a single direction parallel to the electrode surface, and the amplitude thereof is about several [nm]. In order to detect the mass of toner, the toner has to be held on the mass detection surface without sliding off due to the shear vibration of the mass detection surface.

The present invention provides a measuring device, a developing device, and an image forming apparatus, which are capable of detecting the toner charge amount with high accuracy by suppressing the sliding of toner during the vibration of a piezoelectric crystal resonator.

SUMMARY OF THE INVENTION

According to one aspect of the present invention, there is provided a detection device configured to detect a charge amount of toner on a developer carrier, comprising: an assembly including a quartz oscillator and having a first surface and a second surface that are provided in the quartz oscillator, the first surface having a recess and a projection formed in a direction in which the quartz oscillator vibrates; a capacitor connected to the assembly; a first measurement unit configured to measure a potential difference between two ends of the capacitor; and a second measurement unit configured to measure a frequency of the quartz oscillator, wherein in a case where an alternating-current power is applied to the assembly, the direction in which the quartz oscillator vibrates is parallel to the first surface.

According to another aspect of the present invention, there is provided a developing device comprising: a development unit including a developer carrier, the development unit being configured to form a toner image by developing an electrostatic latent image formed on a photoreceptor using toner carried by the developer carrier; and a detection device configured to detect a charge amount of toner on a developer carrier, wherein the detection device comprises: an assembly including a quartz oscillator and having a first surface and a second surface that are provided in the quartz oscillator, the first surface having a recess and a projection formed in a direction in which the quartz oscillator vibrates; a capacitor connected to the assembly; a first measurement unit configured to measure a potential difference between two ends of the capacitor; and a second measurement unit configured to measure a frequency of the quartz oscillator, wherein in a case where an alternating-current power is applied to the assembly, the direction in which the quartz oscillator vibrates is parallel to the first surface.

According to another aspect of the present invention, there is provided an image forming apparatus comprising: a photoreceptor; an exposure unit configured to expose the photoreceptor so as to form an electrostatic latent image; a development unit including a developer carrier that carries toner, the development unit being configured to form a toner image by developing the electrostatic latent image; an assembly including a quartz oscillator and having a first surface and a second surface that are provided in the quartz oscillator, the first surface having a recess and a projection formed in a direction in which the quartz oscillator vibrates; a capacitor connected to the assembly; a first measurement unit configured to measure a potential difference between two ends of the capacitor; a second measurement unit configured to measure a frequency of the quartz oscillator, and a determination unit configured to determine a charge amount of toner on the first surface, on the basis of the potential difference measured by the first measurement unit and the frequency measured by the second measurement unit.

According to the present invention, the toner charge amount can be detected with high accuracy.

Further features of the present invention will become apparent from the following description of exemplary embodiments with reference to the attached drawings.

DESCRIPTION OF THE EMBODIMENTS

Embodiment 1

Configuration of QCM Quartz Sensor

The configuration of a QCM quartz sensor for measuring the mass of toner to be used in this example will be described with reference to FIG. 17A, FIG. 17B, and FIG. 18.

Figure 17A:
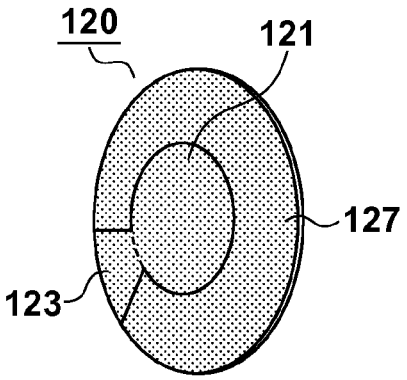
FIGS. 17A and 17B are views showing a configuration of a QCM quartz sensor of Embodiment 1.
Figure 17B:
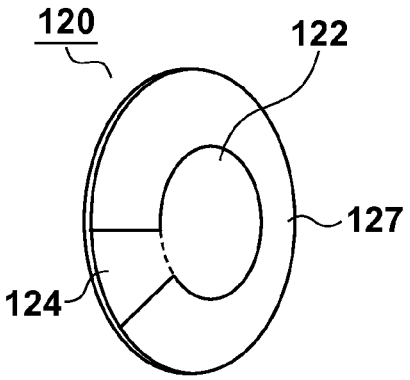

FIGS. 17A and 17B are perspective views of the QCM quartz sensor, as viewed from the respective directions of two electrode surfaces. A QCM quartz sensor 120 is composed of a toner adsorption surface electrode 121, a non-toner-adsorption surface electrode 122, an electrode terminal 123 on the toner adsorption surface electrode 121 side, an electrode terminal 124 on the non-toner-adsorption surface electrode 122 side, and a quartz piece 127 (quartz oscillator). In this example, the surface of the electrode terminal 123 is coated with an insulating material so as to prevent incorporation of electrical disturbance components. The toner adsorption surface electrode 121 corresponds to a first electrode provided on one surface (first surface) of the quartz piece 127 (quartz oscillator), and the non-toner-adsorption surface electrode 122 corresponds to a second electrode provided on the other surface (second surface) of the quartz piece 127 (quartz oscillator). That is, the QCM quartz sensor 120 has electrodes on both sides. Since the measurement principle of the QCM quartz sensor 120 is described in detail, for example, in Japanese Patent No. 3725195, only a summary will be described herein.

Figure 18:
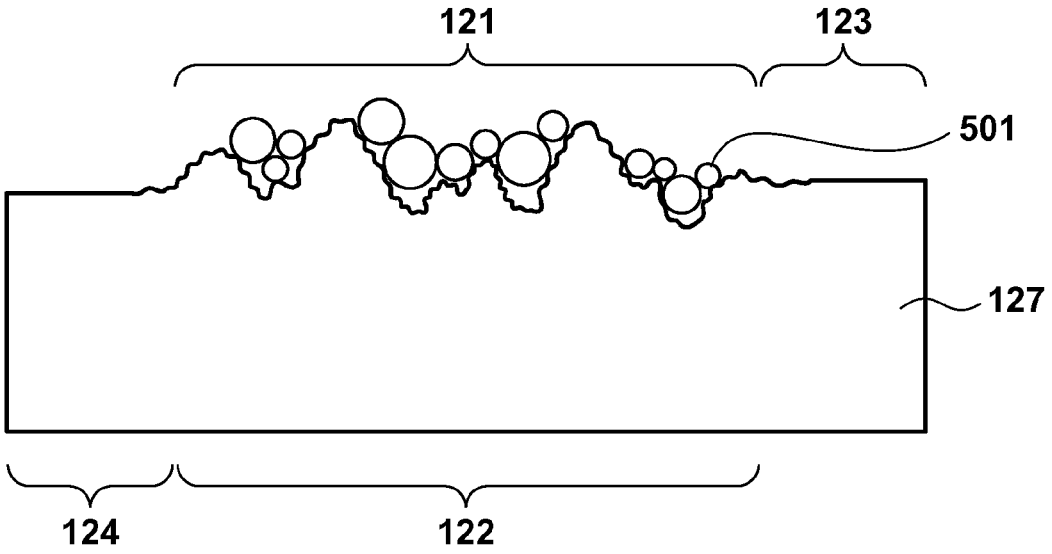
FIG. 18 is a view showing a cross section of the QCM quartz sensor of Embodiment 1.

FIG. 18 is a sectional view of the toner adsorption surface electrode 121. In this example, the surface of the toner adsorption surface electrode 121 is a roughened surface with an average depth of 5 [μm]. The thickness of the quartz piece 127, for example, is 500 [μm]. FIG. 18 shows a view that emphasizes the structure of projections and recesses with an average depth of 5 [μm]. The projections and recesses of the quartz oscillator shown in FIG. 18 are formed by lapping with abrasive grains having a particle size of #800, and thereafter forming electrodes using 50 [nm] of Au. The resonance frequency of the quartz piece 127 is 5.003 [MHz].

Figure 2A:
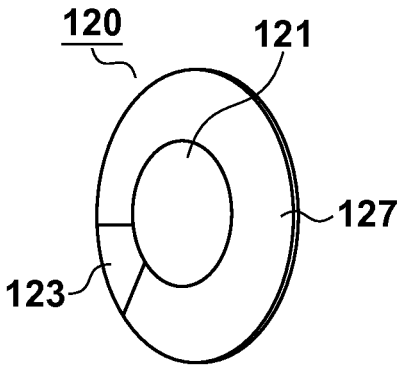
FIGS. 2A and 2B are views showing a configuration example of a conventional QCM quartz sensor.
Figure 2B:
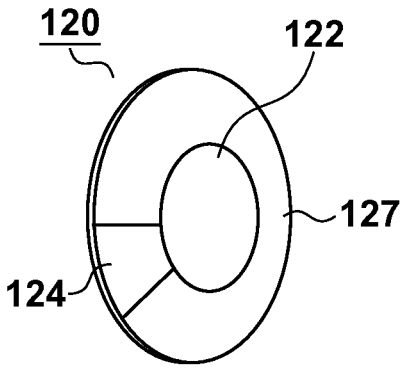
Figure 21:
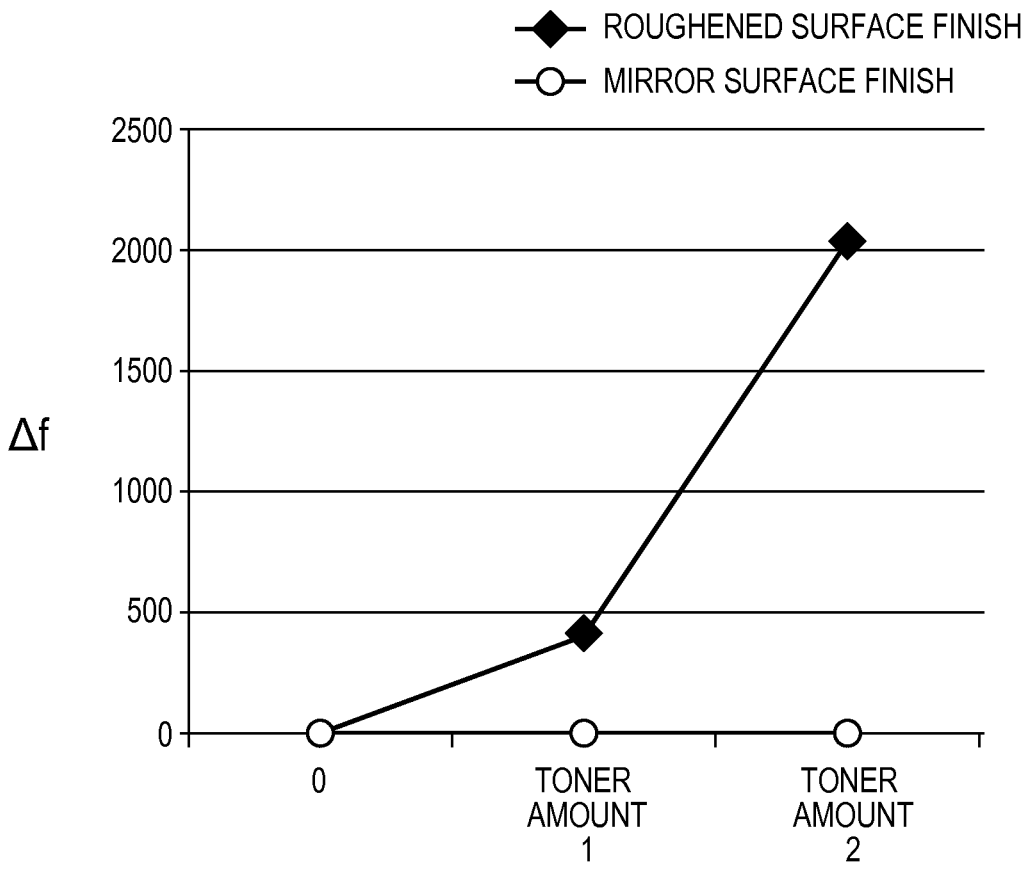
FIG. 21 is a graph showing change in resonance frequency of the QCM quartz sensor due to toner.

FIG. 21 shows the results of measuring a change ΔF in the resonance frequency of the toner adsorption surface electrode 121 shown in FIG. 18 onto which toner having an average particle size of 6 [μm] is applied. In FIG. 21, the vertical axis indicates the change ΔF in the resonance frequency, and the horizontal axis indicates the amount of toner applied to the quartz oscillator. Further, FIGS. 2A and 2B are perspective views of the QCM quartz sensor 120 in which the toner adsorption surface electrode 121 has a mirror surface finish. FIGS. 2A and 2B and FIGS. 19A and 19B differ with regard to whether or not there are projections and recesses on the surface on which the toner adsorption surface electrode 121 is provided, and are the same with regard to the other configurations.

FIG. 21 shows the results of measuring the change ΔF in the resonance frequency in the cases where toner is applied to the QCM quartz sensor 120 shown in FIGS. 17A and 17B, which has a roughened surface finish, and to the QCM quartz sensor 120 shown in FIGS. 2A and 2B, which has a mirror surface finish. The amount of toner applied to the QCM quartz sensor 120, which is shown as the toner amount 1, is greater than the amount shown as the toner amount 2. As shown by the symbol "○" in FIG. 21, the resonance frequency of the QCM quartz sensor 120 with a mirror surface finish (FIGS. 2A and 2B) did not change at all, even when the amount of toner was changed. On the other hand, the resonance frequency of the QCM quartz sensor 120 of this example (FIGS. 17A and 17B) changed according to the amount of toner, as shown by the symbol "◆" in FIG. 21. In the QCM quartz sensor 120 of this example, the resonance frequency was reduced as the amount of toner increased, and the resonance frequency increased when the toner was removed from the QCM quartz sensor 120. It has been experimentally confirmed that the resonance frequency of the QCM quartz sensor 120 of this example ("◆" in FIG. 21) returns to 5.003 [MHz] when the toner adhering to the QCM quartz sensor 120 is completely removed. Further, the response speed of the QCM quartz sensor 120 was several milliseconds or less, which is extremely high-speed.

In the QCM quartz sensor 120 of this embodiment (FIGS. 17A and 17B), the projections and recesses formed on the toner adsorption surface electrode 121 had an average depth of 5 [μm]. However, the projections and recesses may have any depth as long as the depth makes it difficult for the toner to slide. For example, the average depth of the projections and recesses may be almost the same as the average particle size. Further, the average depth of the projections and recesses may be larger than the average particle size, for example. Since the toner adsorption surface electrode 121 is processed into a roughened surface, the contact area between the toner and the toner adsorption surface electrode 121 increases, thereby suppressing the sliding of the toner when the toner adsorption surface electrode 121 is subjected to shear vibration.

This embodiment enables detection of the mass of toner, since the roughened surface of the toner adsorption surface electrode 121 prevents the toner from sliding laterally, even when the QCM quartz sensor 120 (FIGS. 17A and 17B) is caused to vibrate.

Embodiment 2

Configuration of QCM Quartz Sensor

Figure 19A:
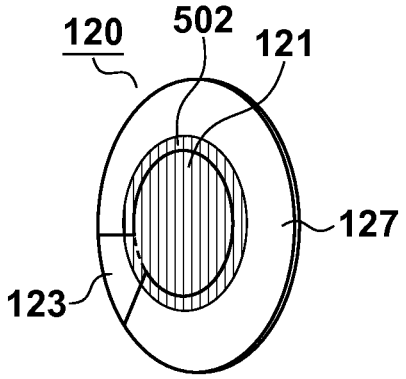
FIGS. 19A and 19B are views showing a configuration of a QCM quartz sensor of Embodiment 2.
Figure 19B:
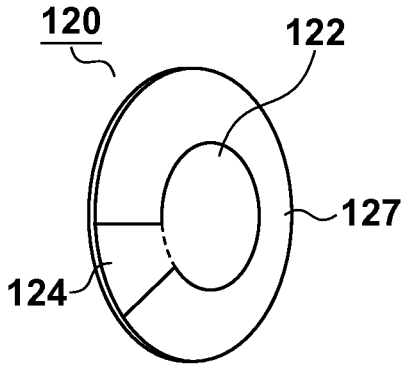

FIGS. 19A and 19B are perspective views of the QCM quartz sensor of this example, as viewed from the respective directions of two electrode surfaces. The QCM quartz sensor 120 of this example is composed of the toner adsorption surface electrode 121, the non-toner-adsorption surface electrode 122, the electrode terminal 123 on the toner adsorption surface electrode 121 side, the electrode terminal 124 on the non-toner-adsorption surface electrode 122 side, and the quartz piece 127 (quartz oscillator), in the same manner as in Embodiment 1. Also in this example, the surface of the electrode terminal 123 is coated with an insulating material so as to prevent incorporation of electrical disturbance components. The toner adsorption surface electrode 121 corresponds to a first electrode provided on one surface (first surface) of the quartz piece 127 (quartz oscillator), and the non-toner-adsorption surface electrode 122 corresponds to a second electrode provided on the other surface (second surface) of the quartz piece 127 (quartz oscillator).

Figure 20:
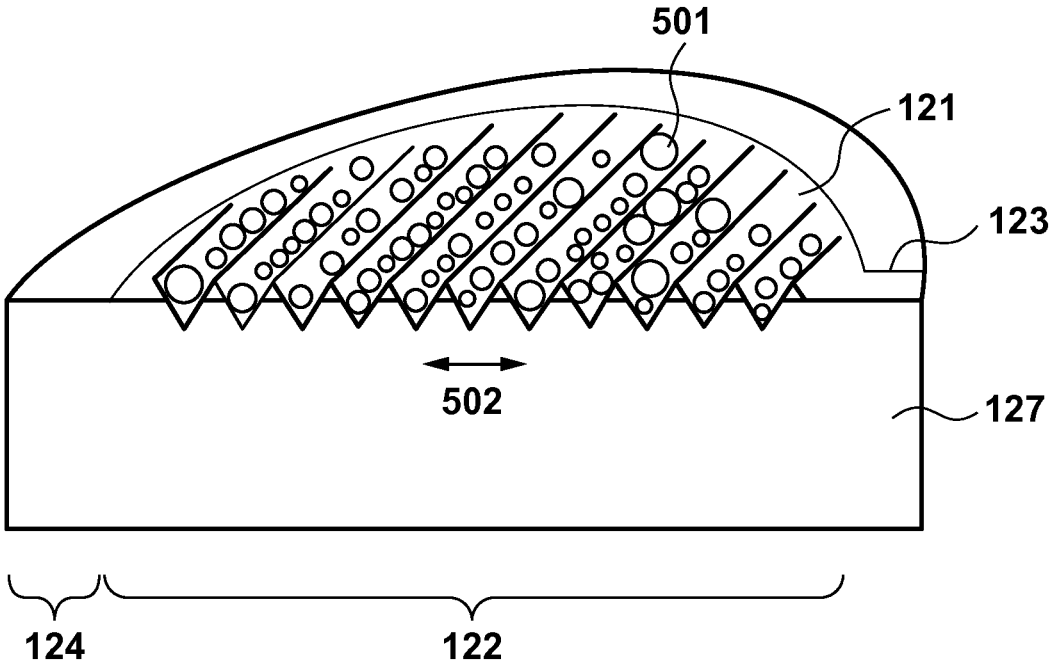
FIG. 20 is a view showing a cross section of the QCM quartz sensor of Embodiment 2.

As shown in FIG. 19A, a plurality of grooves having a depth of 5 [μm] are formed on the toner adsorption surface electrode 121. FIG. 20 is a schematic view of a cross section of the toner adsorption surface electrode 121. In this example, the direction in which the plurality of grooves are aligned is parallel to the direction of shear vibration of the quartz piece 127 (arrow 502). That is, the grooves are formed extending in a direction orthogonal to the direction of shear vibration of the quartz piece 127. FIG. 20 shows a view that emphasizes the projections and recesses of the plurality of grooves having an average depth of 5 [μm]. The projections and recesses on the surface of the toner adsorption surface electrode 121 shown in FIG. 20 are formed by forming a resist, after exposure and development, by RIE processing under CF4+O2 gas flow, and thereafter separating the resist from the surface of the toner adsorption surface electrode 121. Further, the toner has an average particle size of 6 [μm] also in this example.

The QCM quartz sensor 120 according to this example is configured so that the grooves extend in the direction almost perpendicular to the vibration direction. The arrow 502 shown in FIG. 20 indicates the vibration direction of the quartz piece 127. The vibration direction is parallel to the toner adsorption surface electrode 121. The grooves holding toner 501 are formed to be almost perpendicular to the arrow 502. Although the grooves have a V-shape as shown in FIG. 20, the shape thereof is not limited to such a V-shape.

In this example, the resonance frequency of the quartz piece 127 was 5.011 [MHz]. In the QCM quartz sensor 120 of Embodiment 2, in the same manner as in Embodiment 1, the resonance frequency was reduced according to the amount of toner applied, and the resonance frequency increased when the toner was removed from the sensor, returning to the original value 5.011 [MHz] upon complete removal. Further, the response speed was several milliseconds or less, which is extremely high-speed, in the same manner as in Embodiment 1.

According to this example, even when the QCM quartz sensor 120 (FIGS. 19A and 19B) is caused to vibrate, the grooves on the toner adsorption surface electrode 121 prevent the toner from sliding laterally, and the mass of the toner can be detected.

Embodiment 3

Apparatus Configuration

Figure 1:
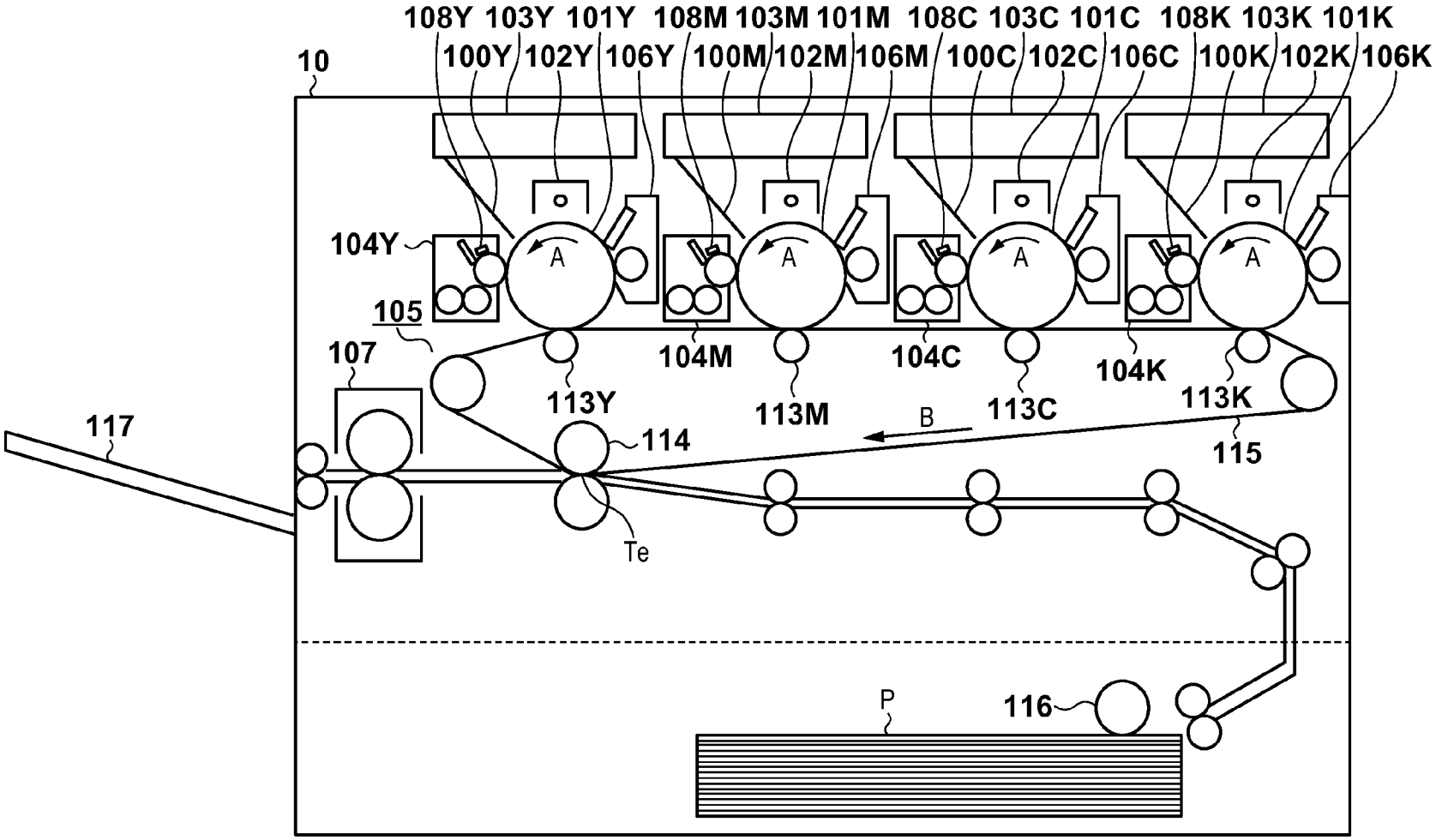
FIG. 1 is a view schematically showing a configuration example of an electrophotographic image forming apparatus.

FIG. 1 is a view schematically showing a configuration example of an electrophotographic image forming apparatus to which the quartz oscillator of Embodiment 1 can be applied. The image forming apparatus is of a four-color tandem type in which a color image is obtained by forming a toner image on a photoreceptor drum for each color, and overlaying toner images of four colors on an intermediate transfer belt. In FIG. 1, the letters Y, M, C, and K attached to the numbers denote colors of toner images to be formed. Y denotes yellow, M denotes magenta, C denotes cyan, and K denotes black.

FIG. 1 shows laser beams 100, photoreceptor drums 101, charging devices 102, laser scanners 103, developing devices 104, a transfer device 105, cleaning devices 106, a fixing device 107, toner charge amount measuring devices 108, primary transfer rollers 113, secondary transfer rollers 114, an intermediate transfer belt 115, a paper feed roller 116, a catch tray 117, and recording paper P. The steps of forming toner images on the photoreceptor drums 101 and overlaying the toner images on the intermediate transfer belt 115 are the same for each color. Therefore, the notation of colors is omitted in the following description. Also in other figures, the same parts and the same functions are denoted by the same numerals.

When a print start signal is input, the surface of a photoreceptor drum 101 is electrically charged to a predetermined potential by a charging device 102. The photoreceptor drum 101 is irradiated with a laser beam 100 modulated on the basis of an image signal from a laser scanner 103, and an electrostatic latent image is formed on the photoreceptor drum 101. A developing device 104 increases the charge amount of toner in a developer contained therein, as will be described below, and thereafter moves the toner with electrostatic force due to the electric field formed between the electrostatic latent image and a developing sleeve 111, so that a toner image is formed on the photoreceptor drum 101. The intermediate transfer belt 115 has a configuration in which it is sandwiched between the photoreceptor drum 101 and a primary transfer roller 113, and a primary transfer nip portion is formed at the sandwiched position. The toner image formed on the photoreceptor drum 101 is transferred onto the intermediate transfer belt 115 by the primary transfer roller 113.

The aforementioned steps are sequentially repeated for each of the four colors, namely yellow, magenta, cyan, and black, and a toner image obtained by overlaying the four colors on the intermediate transfer belt 115 is thereby formed. After the toner image is transferred, a cleaning device 106 removes adhering materials, such as toner which failed to be transferred, from the surface of the photoreceptor drum 101, for repeated use in image formation.

Recording sheets P contained in a paper cassette are separated one-by-one by the paper feed roller 116 and conveyed to the portion in contact with the intermediate transfer belt 115.

At a secondary transfer nip portion formed by a secondary transfer roller 114 and the intermediate transfer belt 115, the toner images on the intermediate transfer belt 115 are transferred to the recording sheet P that was conveyed from the paper cassette and are fixed by application of heat and pressure in the fixing device 107. The recording sheet P to which the image has been fixed is discharged onto the catch tray 117.

The above described a general configuration of a tandem color electrophotographic image forming apparatus using an intermediate transfer member and image forming steps thereof.

In addition to the aforementioned image forming steps, this example includes a step of measuring the mass M and the charge amount Q of toner before the toner is developed on the photoreceptor drum 101, using a toner charge amount measuring device 108 provided in the developing device 104, and a step of controlling the amount of the laser beam 100 emitted from the laser scanner 103, on the basis of the mass M and the charge amount Q of toner that were measured.

In this example, the toner charge amount measuring device 108 uses the QCM quartz sensor 120 described in Embodiment 2. The QCM quartz sensor 120 of Embodiment 1 may be used instead of the QCM quartz sensor 120 of Embodiment 2 as the toner charge amount measuring device 108.

Configuration of Developing Device

Figure 3:
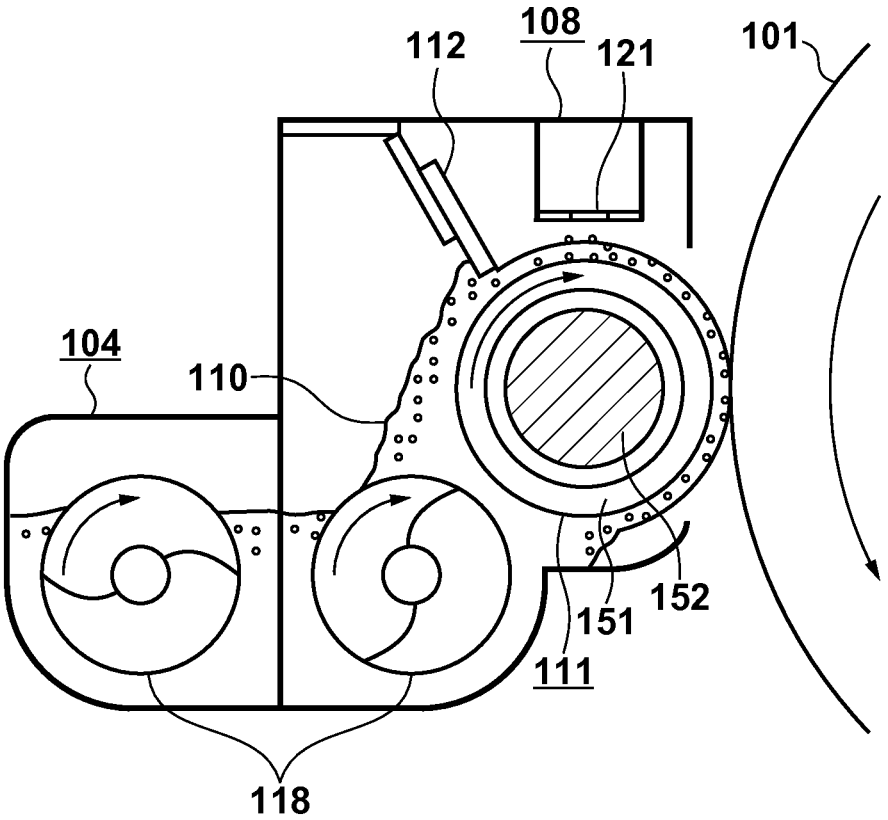
FIG. 3 is a view showing a configuration example of a developing device.

FIG. 3 is a view showing a configuration example of a developing device 104 used in the present embodiment. The developing device 104 includes a developing sleeve 111, a regulating blade 112, mixing screws 118, a cylindrical member 151, a magnet 152, and the toner charge amount measuring device 108 having the QCM quartz sensor 120. Developer 110 is contained in the developing device 104.

The developer 110 has a toner and a carrier that is a magnetic material. The mixing screws 118 convey the toner to the developing sleeve 111 while generating contact friction between the toner and the carrier of the developer 110 so that the toner is electrically charged. The developing sleeve 111 is composed of a revolvable non-magnetic cylindrical member 151 and a magnet 152 having a magnetic force. The magnet 152 is included in the cylindrical member 151. The developing sleeve 111 attracts the developer 110 onto its surface due to the magnetic force of the magnet 152 and by the rotation of the cylindrical member 151, and the developer 110 is conveyed downstream in the rotational direction shown by the arrows. The developer 110 carried by the developing sleeve 111 passes through the gap between the developing sleeve 111 and the regulating blade 112. This regulates the amount of toner carried on the developing sleeve 111. Further, due to the developer 110 passing through the gap, the toner charge amount increases.

The toner charge amount measuring device 108 is arranged downstream of the regulating blade 112 and before the position where the toner is developed on the photoreceptor drum 101, as shown in FIG. 3. The toner charge amount measuring device 108 is arranged so that the toner adsorption surface electrode 121 is not in contact with the developer 110 on the developing sleeve 111. In this embodiment, the toner charge amount measuring device 108 is arranged so that the distance between the toner carried on the developing sleeve 111 and the surface of the toner adsorption surface electrode 121 is several [mm] or less, for example.

Description of Charge Amount at the Time of Charging Toner

Figure 4:
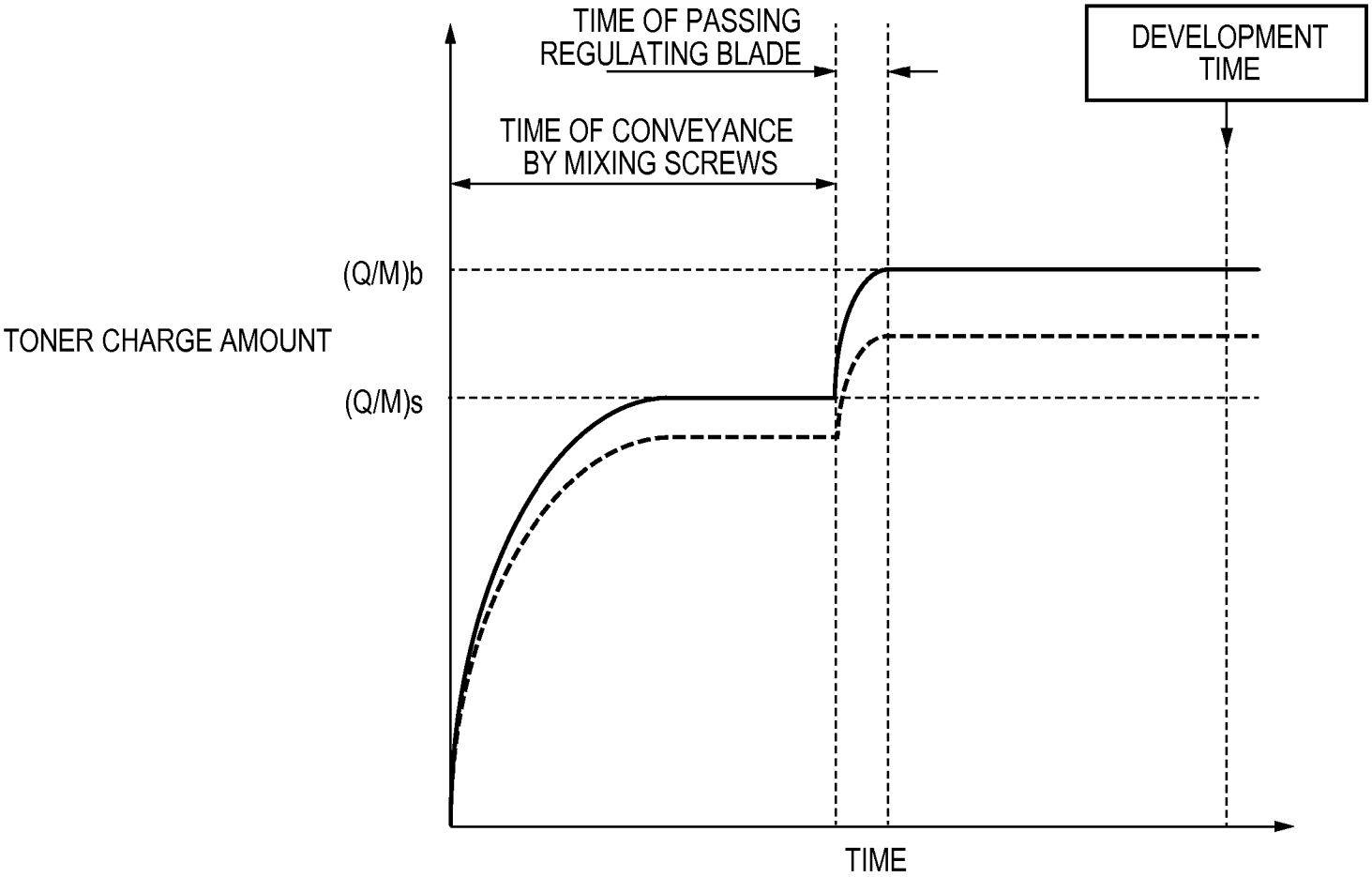
FIG. 4 is a graph showing variations in charge amount of toner in the developing device.

FIG. 4 is a graph showing change in the charge amount of toner in the developing device. In FIG. 4, the horizontal axis indicates time, and the vertical axis indicates the toner charge amount (Q/M). The solid line indicates change in the charge amount of toner having desired charge characteristics, and the dashed line indicates change in the charge amount of toner having charge characteristics that are different from the desired charge characteristics. When toner supplied to the developing device 104 is mixed by the mixing screws 118, the toner is electrically charged to a predetermined value $(Q/M)_s$ due to the friction between particles of the toner. When the toner supplied to the developing sleeve 111 passes through the regulating blade 112, the electrical charge is further accelerated, and the charge amount of toner on the developing sleeve 111 increases up to a target value $(Q/M)_b$. The target value $(Q/M)_b$ corresponds to a theoretical value of the charge amount of toner on the developing sleeve 111 in the case where the toner in the developing device 104 has the desired charge characteristics.

On the other hand, the charge amount of toner having charge characteristics that are different from the desired charge characteristics does not reach the target value $(Q/M)_b$ even when the toner supplied to the developing sleeve 111 passes through the regulating blade 112. Therefore, the amount of toner adhering to the electrostatic latent image on the photoreceptor drum 101 varies. Therefore, the density and color tone of the toner image developed using the toner having charge characteristics different from the desired charge characteristics will not be the desired density and color tone.

Examples of factors that cause variation in the toner charge amount (Q/M) include changes in temperature or humidity in the environment in which the image forming apparatus is installed, deterioration in the carrier due to long-term use, and change in the amount of toner that is consumed or supplied. Further, in the case where the developer is left for a long time without being used, the charge amount of toner within the image forming apparatus decreases. Therefore, the toner charge amount will change drastically immediately after the developing device 104 starts mixing the developer.

If the amount of toner that is consumed or supplied changes, or the developing device 104 starts mixing the developer after the developer has been left for a long time without being used, the toner charge amount will change in a short time. If the toner charge amount changes in a short time, the toner charge amount (Q/M) may possibly vary during the output of one page.

In the case where toner is developed from the developing sleeve 111 to the photoreceptor drum 101 under the same development conditions, if the toner charge amount is different from the target value, the amount of toner adhering to the photoreceptor drum 101 will be different. Therefore, the density and color tone of the output image will vary.

For example, in the case where an electrostatic latent image is developed using toner with a charge amount (Q/M) that is lower than the target value $(Q/M)_b$, the amount of toner adhering to the photoreceptor drum 101 increases. As a result, the density of the output image exceeds the desired density. On the other hand, in the case where an electrostatic latent image is developed using toner with a charge amount (Q/M) that is higher than the target value $(Q/M)_b$, the amount of toner adhering to the photoreceptor drum 101 decreases. As a result, the density of the output image falls below the desired density.

In this embodiment, a CPU 606 (FIG. 5) controls the image forming conditions on the basis of the measurement results of the charge amount (Q/M) of toner that is to be supplied to the photoreceptor drum 101, even when the toner charge amount (Q/M) varies. Specifically, it controls the laser beam 100 for forming an electrostatic latent image on the photoreceptor drum 101. This allows adjustment of the surface potential of the photoreceptor drum 101, thereby allowing the amount of toner adhering to the photoreceptor drum 101 to be controlled. Thus, the density of the output image can be adjusted to the desired density on the basis of the toner charge amount (Q/M).

Next, a method for measuring the toner charge amount Q/M will be described.

Figure 5:
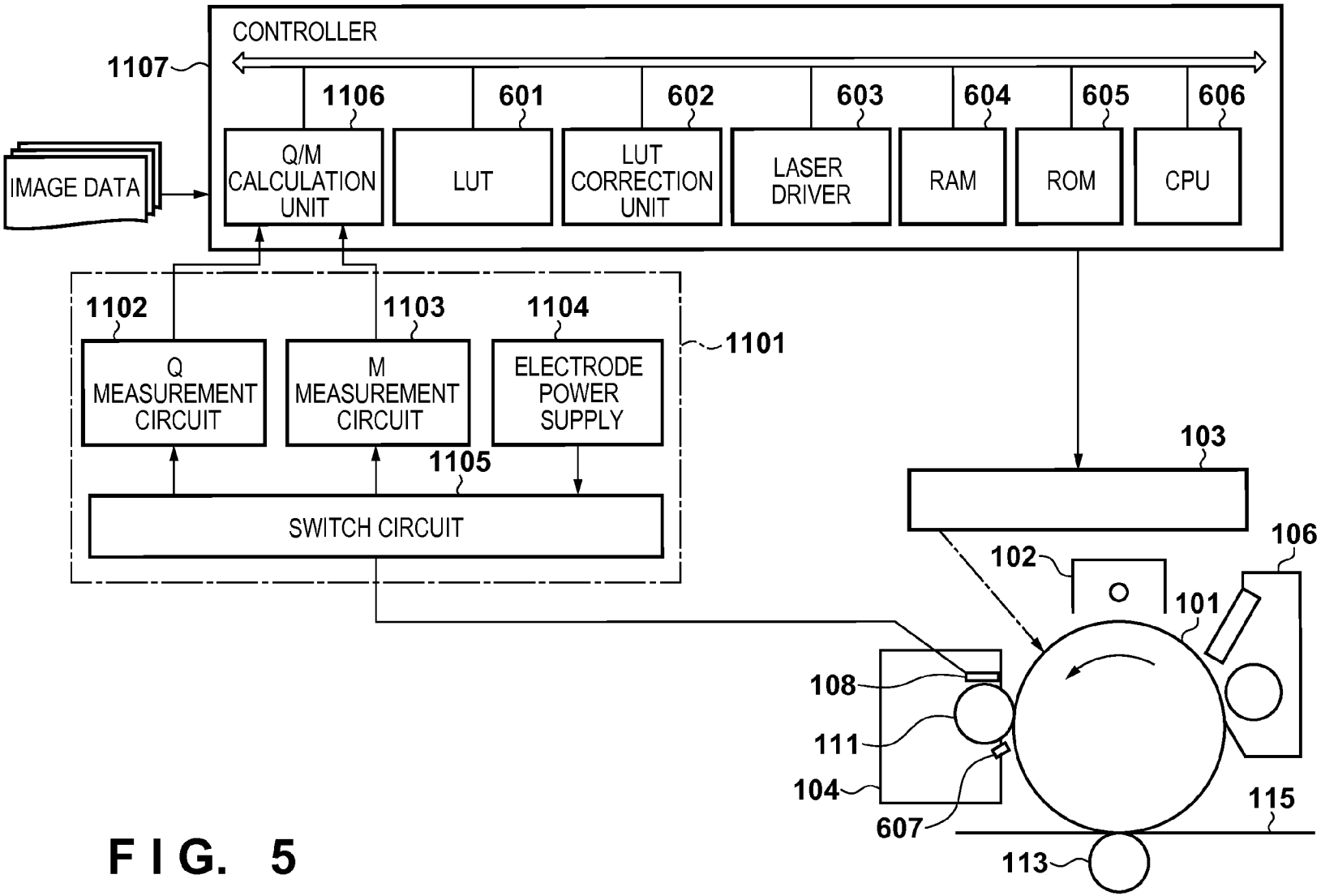
FIG. 5 is a diagram showing a configuration example in the periphery of a QCM quartz sensor.

FIG. 5 is a block diagram showing an electrical configuration for detecting the toner charge amount. A controller 1107 controls an image forming station including the photoreceptor drum 101, the charging device 102, the laser scanner 103, the developing device 104, the cleaning device 106, and the primary transfer roller 113.

In FIG. 5, a Q/M measurement unit 1101 has a Q measurement circuit 1102, an M measurement circuit 1103, an electrode power supply 1104, and a switch circuit 1105. The Q/M measurement unit 1101 allows toner carried by the developing sleeve 111 to be adsorbed on the toner adsorption surface electrode 121, measures the mass M of toner adsorbed on the toner adsorption surface electrode 121, or measures the charge amount Q of toner adhering to the toner adsorption surface electrode 121. The circuit configuration of the Q/M measurement unit 1101 will be described below in "Detailed description of Q/M measurement unit". Further, the controller 1107 includes a Q/M calculation unit 1106, a LUT (Look Up Table) 601, a LUT correction unit 602 that corrects the LUT 601, a laser driver 603 that controls the laser scanner 103, a RAM 604, a ROM 605, and the CPU 606. The LUT 601 is conversion data for converting image data into laser drive signals for controlling the laser scanner 103. A method for correcting the LUT will be described below. The RAM 604 is a storage unit configured to retain rewritable data. The ROM 605 is a storage unit configured to store pre-set data. The CPU 606 performs the control and calculation of each part of the controller 1107.

Next, a toner charge amount measurement sequence for measuring the toner charge amount will be described on the basis of FIG. 6. In this embodiment, the Q/M measurement unit 1101 and the Q/M calculation unit 1106 detect the charge amount Q/M of toner on the developing sleeve 111 while a toner image is being formed on the basis of image data, and while a patch image, which will be described below, is being formed by the image forming station.

In step S1301, the controller 1107 charges a Q measurement capacitor C1 of the Q measurement circuit 1102 (FIG. 11) before the adsorption of toner on the toner adsorption surface electrode 121 of the toner charge amount measuring device 108. In this example, a potential for adsorption of toner on the toner adsorption surface electrode 121 (hereinafter, referred to as "toner adsorption potential") is not directly supplied from the electrode power supply 1104, but power is supplied from the Q measurement capacitor C1 to the toner adsorption surface electrode 121, after the Q measurement capacitor C1 of the Q measurement circuit 1102 (FIG. 11) is charged to the toner adsorption potential. The reason why power is not directly supplied from the electrode power supply 1104 is to prevent the electric charge of adsorbed toner from being discharged through the electrode power supply 1104 when the toner is adsorbed on the toner adsorption surface electrode 121. This step will be described in detail below on the basis of FIG. 9.

In step S1302, the controller 1107 separates the toner adhering to the toner adsorption surface electrode 121. The Q/M measurement unit 1101 electrostatically separates the toner adhering to the toner adsorption surface electrode 121 by applying a potential for separating the toner adhering to the toner adsorption surface electrode 121 (hereinafter, referred to as "toner separation potential") to the toner adsorption surface electrode 121 via the electrode terminal 123. This step will be described in detail below on the basis of FIG. 10. In step S1303, the controller 1107 measures a reference value V1 for the potential difference between the two ends of the Q measurement capacitor C1 charged in step S1301 and a reference value f1 of the resonance frequency of the quartz piece 127 before the adsorption of toner on the toner adsorption surface electrode 121. This step will be described in detail below on the basis of FIG. 11. In step S1304, the controller 1107 allows the toner to be electrostatically adsorbed on the toner adsorption surface electrode 121 using the toner adsorption potential with which the Q measurement circuit 1102 has been charged. This step will be described in detail below on the basis of FIG. 12.

In step S1305, the controller 1107 measures a potential difference V2 between the two ends of the Q measurement capacitor C1 and a resonance frequency f2 of the quartz piece 127 while toner is adsorbed on the toner adsorption surface electrode 121. Then, the controller 1107 computes the charge amount Q and the mass M of the toner adhering to the toner adsorption surface electrode 121. The controller 1107 calculates the charge amount Q of the toner adsorbed on the toner adsorption surface electrode 121, on the basis of the potential V1 measured before the toner was adsorbed on the toner adsorption surface electrode 121 and the potential difference V2 measured while the toner is adsorbed on the toner adsorption surface electrode 121. Further, based on the resonance frequency f1 measured before the toner was adsorbed on the toner adsorption surface electrode 121 and the resonance frequency f2 measured while the toner is adsorbed on the toner adsorption surface electrode 121, the controller 1107 calculates the mass M of the toner adsorbed on the toner adsorption surface electrode 121 using a later-described calculation formula.

In step S1306, the controller 1107 determines the charge amount Q/M of the toner adhering to the toner adsorption surface electrode 121, on the basis of the charge amount Q and the mass M computed in step S1305. The controller 1107 detects the toner charge amount Q/M by dividing the charge amount Q of toner adsorbed on the toner adsorption surface electrode 121 by the mass M thereof using the Q/M calculation unit 1106.

In step S1307, the controller 1107 determines whether to end the measurement or to perform the next measurement. In this example, the measurement of the toner charge amount Q/M is performed while the image forming steps are being performed. Therefore, in step S1307, if the image forming steps are currently being executed, the controller 1107 returns to step S1301, and if the image forming steps have ended, the controller 1107 ends the toner charge amount measurement sequence for measuring the toner charge amount Q/M.

It should be noted that the amount of toner adsorbed on the toner adsorption surface electrode 121 from the photoreceptor drum 101 in one instance of measurement is several [μg] to several tens [μg], which is an extremely small amount, and thus does not affect the density of the output image. Accordingly, the toner charge amount Q/M can be continuously measured during image formation by repeating the process shown in FIG. 6.

The LUT correction unit 602 shown in FIG. 5 corrects the LUT 601 on the basis of the measured toner charge amount Q/M. The laser driver 603 sets the blink timing of the laser beam on the basis of the corrected LUT 601. The laser scanner 103 exposes the photoreceptor drum 101 to the laser beam 100 whose blink timing has been adjusted, so as to form an electrostatic latent image that is suitable for the toner charge amount Q/M on the photoreceptor drum 101.

Detailed Description for Q/M Measurement

Next, the steps of the toner charge amount measurement sequence shown in FIG. 6 will be described in detail. Descriptions are given herein with reference to the circuit diagram of FIG. 7 and the timing chart of FIG. 8.

Figure 7:
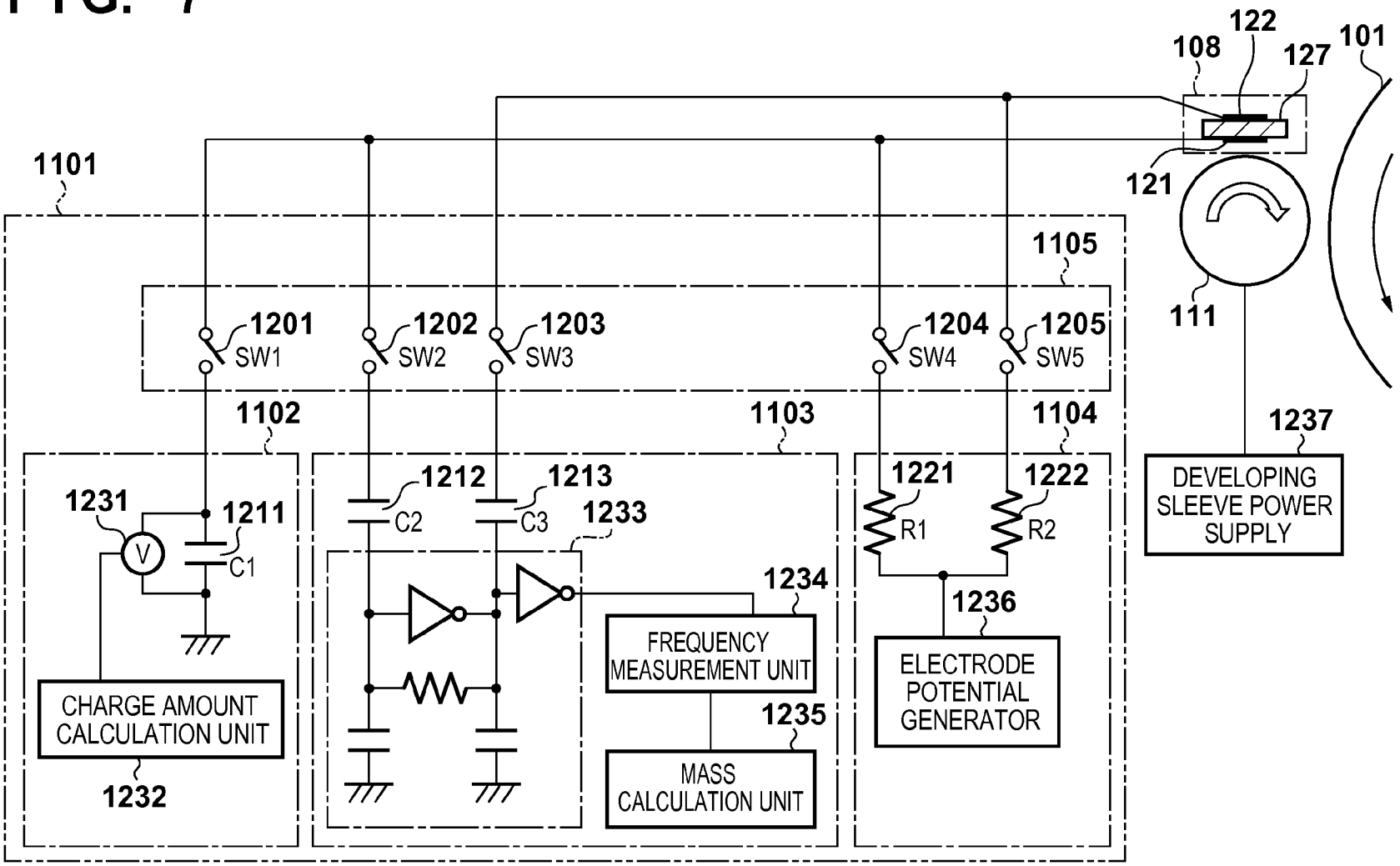
FIG. 7 is a circuit diagram showing a configuration example of a circuit.

FIG. 7 is a circuit diagram of the Q/M measurement unit 1101. A switch 1201 electrically connects and disconnects the toner adsorption surface electrode 121 to or from the Q measurement circuit 1102 (hereinafter, referred to as "SW1"). A switch 1202 electrically connects or disconnects the toner adsorption surface electrode 121 to the M measurement circuit 1103 (hereinafter, referred to as "SW2"). A switch 1203 electrically connects or disconnects the non-toner-adsorption surface electrode 122 to or from the M measurement circuit 1103 (hereinafter, referred to as "SW3"). A switch 1204 electrically connects or disconnects the toner adsorption surface electrode 121 to the electrode power supply 1104 (hereinafter, referred to as "SW4"). A switch 1205 electrically connects or disconnects the non-toner-adsorption surface electrode 122 to or from the electrode power supply 1104 (hereinafter, referred to as "SW5").

A Q measurement capacitor 1211 (hereinafter, referred to as "C1") is a Q measurement capacitor for measuring the charge amount Q, and is charged to the toner adsorption potential. A capacitor 1212 (hereinafter, referred to as "C2") is inserted between the toner adsorption surface electrode 121 and the M measurement circuit 1103, and is a coupling capacitor configured to transmit only high-frequency oscillation signals. A capacitor 1213 (hereinafter, referred to as "C3") is inserted between the non-toner-adsorption surface electrode 122 and the M measurement circuit 1103, and is a coupling capacitor configured to transmit only high-frequency oscillation signals.

A resistor 1221 and a resistor 1222 are resistors for preventing short circuiting of the two electrode terminals 123 and 124 when an electrode potential generator 1236 is connected to both of the toner adsorption surface electrode 121 and the non-toner-adsorption surface electrode 122. Hereinafter, the resistor 1221 will be referred to as R1, and the resistor 1222 will be referred to as R2. An electrometer 1231 measures the potential of the Q measurement capacitor 1211 (C1). A charge amount calculation unit 1232 calculates the charge amount Q on the basis of the difference (V1−V2) between the reference value V1 of the potential difference between the two ends of the Q measurement capacitor C1, which is measured before toner is adsorbed on the toner adsorption surface electrode 121, and the potential difference V2 between the two ends of the Q measurement capacitor C1, which is measured while toner is adsorbed on the toner adsorption surface electrode 121. That is, the charge amount calculation unit 1232 corresponds to a charge amount detection unit that detects the charge amount Q of toner adsorbed on the toner adsorption surface electrode 121, on the basis of the potential difference between the two ends of the Q measurement capacitor C1. An oscillation circuit 1233 oscillates the quartz piece 127. The oscillation circuit shown in FIG. 7 is composed of logic ICs, a resistor, and capacitors. The configuration of the oscillation circuit 1233 is not necessarily limited to such a configuration, and another oscillation circuit may be used.

A frequency measurement unit 1234 measures the oscillation frequency of the oscillation circuit 1233. A mass calculation unit 1235 calculates the mass M based on the difference (f1−f2) between the oscillation frequency f1 measured before toner is adsorbed on the toner adsorption surface electrode 121, and the oscillation frequency f2 measured while toner is adsorbed on the toner adsorption surface electrode 121. That is, the mass calculation unit 1235 corresponds to a mass detection unit that detects the mass of toner adsorbed on the toner adsorption surface electrode 121. The electrode potential generator 1236 outputs a toner adsorption potential, a developing bias, a toner separation potential, or 0 [V] potential. A developing sleeve-power supply 1237 applies a developing bias to the developing sleeve 111.

In this example, the developing bias, for example, is a blank pulse that alternates between a pulse period during which the voltage value periodically changes between +300 [V] and −1200 [V] and a blank period during which the voltage value is constant. At this time, the direct current component of the developing bias is −450 [V]. It should be noted that the developing bias is not limited to the blank pulse, and may be a direct current voltage or a sine wave. The developing bias may be selected appropriately according to the configuration of the developing device 104 or the composition of toner.

Figure 8:
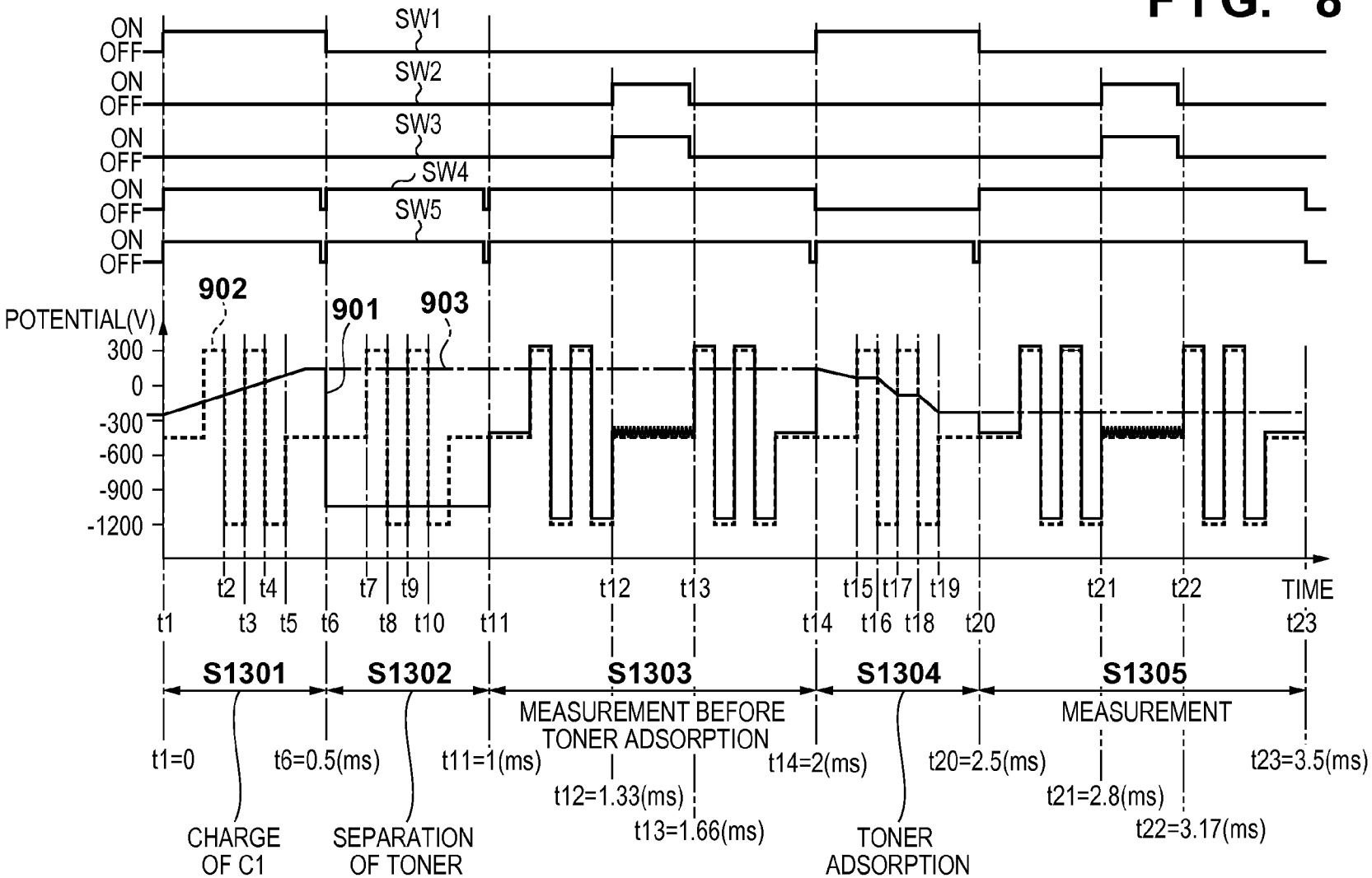
FIG. 8 is a timing chart according to an embodiment.

The timing chart of FIG. 8 shows the relationship between the ON or OFF states of the SW1, the SW2, the SW3, the SW4, and the SW5 serving as switches, the potential of the developing sleeve 111 to which a blank pulse is applied, the surface potential of the toner adsorption surface electrode 121, and the potential difference between the two ends of the Q measurement capacitor C1. A solid line 901 indicates the surface potential of the toner adsorption surface electrode 121. A dotted line 902 indicates the potential of the blank pulse that is to be applied to the developing sleeve 111. A dashed-dotted line 903 indicates the potential difference between the two ends of the Q measurement capacitor C1. It should be noted that, since the Q measurement capacitor C1 is grounded, the potential difference between the two ends of the Q measurement capacitor C1 is the potential of the Q measurement capacitor C1 itself.

In the following description, the length of the blank period is set to one pulse in order to simplify the description. Further, one or two pulses are used in each sequence as well in order to simplify the description.

Charging of Toner Adsorption Potential

Figure 9:
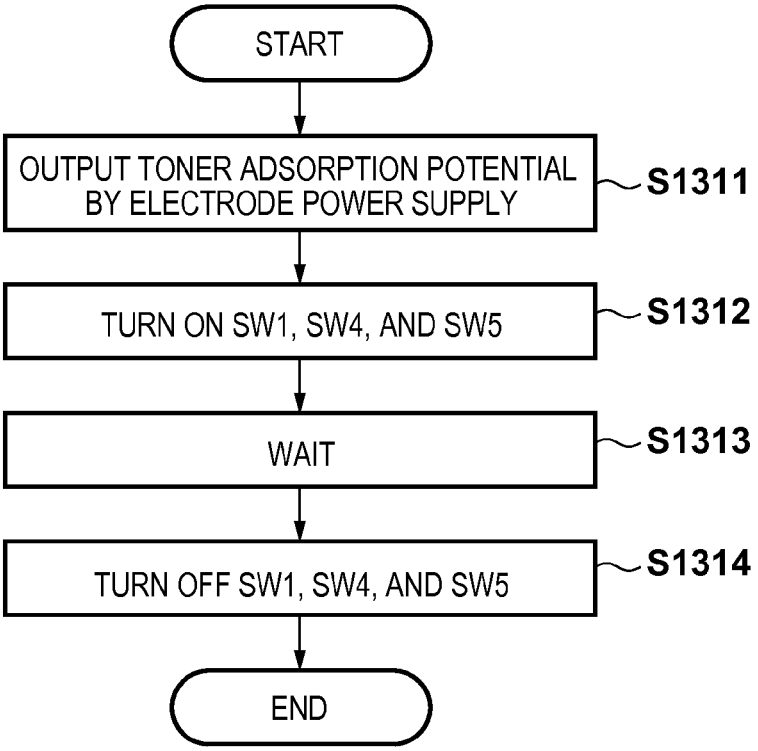
FIG. 9 is a flowchart for charging to a toner adsorption potential in Q/M measurement.

A toner adsorption potential charging sequence (step S1301) in the toner charge amount measurement sequence (FIG. 6) will be described on the basis of FIG. 9.

In step S1311, the controller 1107 causes the electrode power supply 1104 to output a toner adsorption potential. In step S1311, the electrode power supply 1104 outputs a toner adsorption potential of +150 [V] for charging the Q measurement capacitor C1 to the toner adsorption potential.

In step S1312, the controller 1107 turns on the SW1, the SW4, and the SW5. When the SW1 and the SW4 are turned on, the electrode power supply 1104 is connected to the Q measurement capacitor C1. Thus, the Q measurement capacitor C1 starts being charged to the toner adsorption potential. For example, a case where a potential of −200 [V] remains in the Q measurement capacitor C1 will be described below. The toner adsorption surface electrode 121 has almost no electrical resistance since it is connected to the Q measurement capacitor C1 via the SW1. On the other hand, the toner adsorption surface electrode 121 is connected to the electrode-potential generator 1236 via the SW4 and the resistor R1. Therefore, when the SW1 and the SW4 are turned on at time t1, the surface potential of the toner adsorption surface electrode 121 is −200 [V], which is the potential of the Q measurement capacitor C1 having no electrical resistance. Further, the SW5 is turned on, and therefore the non-toner-adsorption surface electrode 122 and the toner adsorption surface electrode 121 have the same potential.

In step S1313, the controller 1107 waits until the potential difference between the two ends of the Q measurement capacitor C1 reaches +150 [V]. In the case where the electrode power supply 1104 outputs a toner adsorption potential of +150 [V], the Q measurement capacitor C1 is charged until the toner adsorption potential +150 [V] is reached, as shown by t1 to t6 in FIG. 8. The charge period is determined according to the potential remaining in the Q measurement capacitor C1 and the time constant of the Q measurement capacitor C1 and the resistor R1.

In step S1313, a toner adsorption potential of +150 [V] is applied also to the toner adsorption surface electrode 121. From time t2 to time t3 and from time t4 to time t5, the potential of the toner adsorption surface electrode 121 of +150 [V] is +1350 [V] higher than the potential of the developing sleeve 111, which is −1200 [V], and therefore toner on the developing sleeve 111 is adsorbed on the toner adsorption surface electrode 121. However, the toner may be adsorbed on the toner adsorption surface electrode 121 in step S1313, since the toner adhering to the toner adsorption surface electrode 121 is separated therefrom in the next step. Further, the electric charge of the toner adsorbed on the toner adsorption surface electrode 121 during the charge period is discharged through the electrode power supply 1104 connected to the toner adsorption surface electrode 121.

In step S1313, the controller 1107 may be configured, for example, to wait for a pre-determined amount of time, or to be provided with a sensor for measuring the potential difference between the two ends of the Q measurement capacitor C1 and wait until the result of measurement performed by the sensor reaches the target value of +150 [V].

In step S1314, the controller 1107 switches the SW1, the SW4, and the SW5 from ON to OFF so as to disconnect the electrical connection of the Q measurement capacitor C1. Thus, the toner adsorption potential of +150 [V] to which the Q measurement capacitor C1 has been charged is maintained.

With that, the toner adsorption potential charging sequence (step S1301) ends.

Toner Separation Before Measurement

Figure 10:
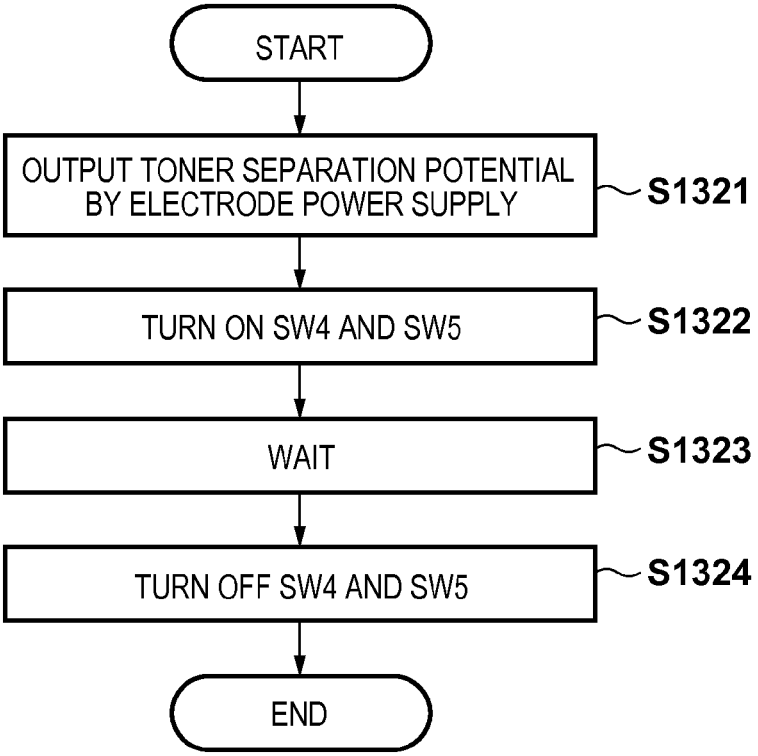
FIG. 10 is a flowchart for separation of toner in Q/M measurement.

The Q/M measurement unit 1101 separates the toner adhering to the toner adsorption surface electrode 121 after the charge is completed. FIG. 10 illustrates a toner separation sequence (step S1302) in the toner charge amount measurement sequence (FIG. 6).

In step S1321, the controller 1107 causes the electrode power supply 1104 to output a toner separation potential. When the electrode power supply 1104 applies a toner separation potential of −1050 [V] to the toner adsorption surface electrode 121 and the non-toner-adsorption surface electrode 122, the toner adhering to the toner adsorption surface electrode 121 is separated therefrom.

In step S1322, the controller 1107 turns on the SW4 and the SW5. When the SW4 and the SW5 are turned on, the electrode power supply 1104 is connected to the electrode terminal 123 of the toner adsorption surface electrode 121, and the electrode power supply 1104 is connected to the electrode terminal 124 of the non-toner-adsorption surface electrode 122, and a toner separation potential of −1050 [V] is supplied thereto. It should be noted that the reason why the SW5 is turned on and the toner separation potential is supplied also to the non-toner-adsorption surface electrode 122 is to prevent breakage of the QCM quartz sensor 120 of the toner charge amount measuring device 108.

In step S1323, the controller 1107 waits for a given period. From time t7 to time t8 and from time t9 to time t10 in FIG. 8, the potential of the toner adsorption surface electrode 121 (−1050 [V]), which is indicated by the solid line 901, is 1350 [V] lower than the potential of the developing sleeve 111 (+300 [V]), which is indicated by the dotted line 902. Accordingly, the toner adsorbed on the toner adsorption surface electrode 121 moves to the developing sleeve 111, and thereby the toner on the toner adsorption surface electrode 121 is separated therefrom. In step S1323, the controller 1107 waits for the amount of time required for all of the toner on the toner adsorption surface electrode 121 to be separated therefrom. The amount of time required for all of the toner on the toner adsorption surface electrode 121 to be separated therefrom is experimentally determined in advance and is stored in the ROM 605.

In step S1324, the controller 1107 turns off the SW4 and the SW5. After the amount of time required for all of the toner on the toner adsorption surface electrode 121 to be separated therefrom has elapsed in step S1323, the controller 1107 turns off the SW4 and the SW5, and thereby toner separation is complete.

In this sequence, the SW1 between the Q measurement circuit 1102 and the toner adsorption surface electrode 121 is always off, and therefore the potential of the Q measurement capacitor C1 is continuously maintained at the toner adsorption potential of +150 [V].

Measurement of Charge Amount and Mass Before Toner Adsorption

A sequence of measurement before the toner adsorption (step S1303) indicated in the toner charge amount measurement sequence (FIG. 6) will be described on the basis of FIG. 11. The controller 1107 executes the measurement sequence of step S1303 before toner is adsorbed on the toner adsorption surface electrode 121 to measure the reference value V1 for the potential difference between the two ends of the Q measurement capacitor C1 and the resonance frequency f1 of the quartz piece 127.

In step S1331, the controller 1107 causes the electrode power supply 1104 to output a developing bias. This is for preventing adsorption of toner on the toner adsorption surface electrode 121 during the measurement of the reference value. The Q/M measurement unit 1101 performs control such that the toner adsorption surface electrode 121 has the same potential as the developing sleeve 111, thereby preventing the toner from moving from the developing sleeve 111 to the toner adsorption surface electrode 121.

That is, the controller 1107 causes the electrode power supply 1104 to supply a blank pulse to the developing sleeve 111. There may be a potential difference between the blank pulse supplied from the electrode power supply 1104 to the toner adsorption surface electrode 121 and the blank pulse supplied from the developing sleeve power supply 1237 to the developing sleeve 111 to some extent, as long as toner is not adsorbed from the developing sleeve 111 onto the toner adsorption surface electrode 121. In FIG. 8, the blank pulse applied to the toner adsorption surface electrode 121 is 20 [V] higher than the blank pulse applied to the developing sleeve 111. For example, the voltage value periodically changes between +320 [V] and −1180 [V] during the pulse period, and the voltage value is −430 [V] during the blank period.

In step S1332, the controller 1107 turns on the SW2, the SW3, the SW4, and the SW5. If the blank pulse is directly applied to the oscillation circuit 1233 from the electrode power supply 1104, the elements of the oscillation circuit 1233 are broken. Therefore, the oscillation circuit 1233 includes coupling capacitors C2 and C3. The coupling capacitors C2 and C3 allow high-frequency signals to pass and does not allow direct current signals and low-frequency signals to pass. When the oscillation frequency of the oscillation circuit 1233 is 5 [MHz], the period thereof is 0.2 [μsec]. The variation time of the developing bias is set to be longer than this cycle, for example, to 2 [μsec]. Then, the capacity of the coupling capacitors C2 and C3 is set to a value that allows oscillation signals of 5 [MHz] to pass and blocks the variation of the developing bias with a variation time of 2 [μsec]. This can prevent a high-potential developing bias from being applied to the oscillation circuit 1233 that operates at several [V].

In step S1333, the controller 1107 measures the potential V1 at both ends of the Q measurement capacitor C1 before toner is adsorbed on the toner adsorption surface electrode 121. The controller 1107 measures the potential difference between the two ends of the Q measurement capacitor C1 using the electrometer 1231 during a blank period (for example, the period from time t12 to time t13). The reason why the potential V1 is measured during the blank period is to avoid the influence of electromagnetic waves radiated during a pulse period. The measured potential V1 is recorded in the charge amount calculation unit 1232 as the potential V1 before toner adsorption.

It should be noted that, since the SW1 is turned off, the Q measurement circuit 1102 is independent from other circuits. In order to shorten the measurement time, the measurement process of step S1333 may be implemented concurrently with step S1334, which will be described below.

In step S1334, the controller 1107 measures the resonance frequency f1 of the quartz piece 127 before toner is adsorbed on the toner adsorption surface electrode 121. The controller 1107 measures the oscillation frequency of the oscillation circuit 1233 using the frequency measurement unit 1234 during a blank period (for example, the period from time t12 to time t13). The reason why the resonance frequency f1 is measured during the blank period is to avoid the influence of a potential variation that is too small to remove completely in the coupling capacitors C2 and C3. The controller 1107 records the measured frequency f1 in the mass calculation unit 1235 as the frequency f1 before toner adsorption.

In step S1335, the controller 1107 turns off the SW2, the SW3, the SW4, and the SW5. Thus, the measurement of the potential V1 before toner adsorption and the frequency f1 before toner adsorption ends.

It is also possible to repeatedly measure the potential V at both ends of the Q measurement capacitor C1 during a blank period before the toner adsorption and use the average of a plurality of measurement results as the potential V1 before the toner adsorption. Likewise, it is also possible to repeatedly measure the resonance frequency f during a blank period before toner adsorption and use the average of a plurality of measurement results as the frequency f1 before toner adsorption. Such a configuration can improve the detection accuracy.

Toner Adsorption

Figure 12:
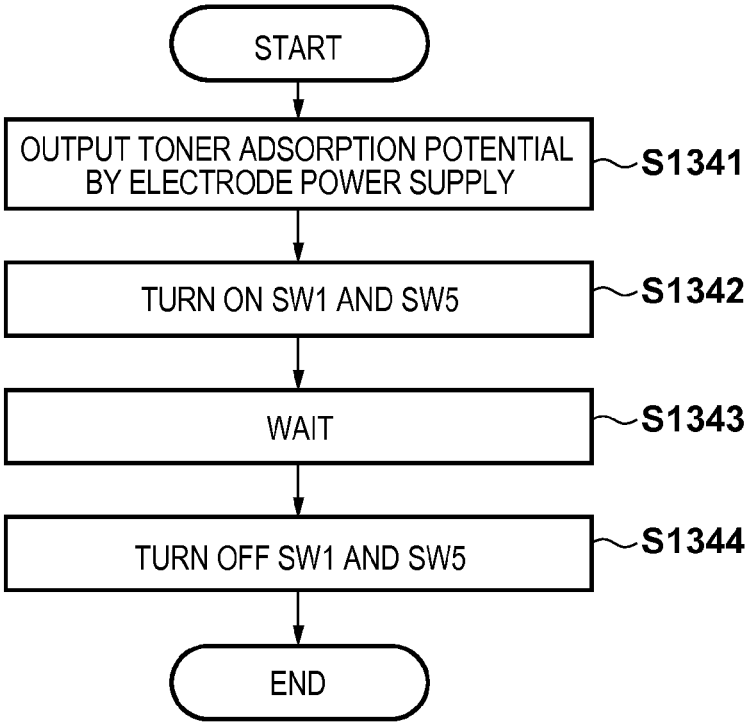
FIG. 12 is a flowchart for toner adsorption in Q/M measurement.

A toner adsorption sequence (step S1304) mentioned in the toner charge amount measurement sequence (FIG. 6) will be described on the basis of FIG. 12.

In step S1341, the controller 1107 causes the electrode power supply 1104 to output a toner adsorption potential. The electrode power supply 1104 outputs a toner adsorption potential of +150 [V] to the non-toner-adsorption surface electrode 122 so that the non-toner-adsorption surface electrode 122 also has the same potential as the toner adsorption surface electrode 121. The toner adsorption surface electrode 121 and the non-toner-adsorption surface electrode 122 are controlled so as to have the same potential, thereby preventing breakage of the toner charge amount measuring device 108.

In step S1342, the controller 1107 turns on the SW1 and the SW5. When the SW1 is turned on, the toner adsorption surface electrode 121 is connected to the Q measurement capacitor C1, and the toner adsorption potential of +150 [V] to which the Q measurement capacitor C1 has been charged is applied to the toner adsorption surface electrode 121. Thereby, the toner on the developing sleeve 111 starts to adsorb on the toner adsorption surface electrode 121. At this time, the SW5 is further turned on, and the toner adsorption potential of +150 [V] is applied also to the non-toner-adsorption surface electrode 122. As a result, breakage of the toner charge amount measuring device 108 is prevented.

In step S1343, the controller 1107 waits for a given period. From time t14 to time t15 (FIG. 8), the potential of the developing sleeve 111 (−450 [V]) is 600 [V] higher than the potential of the toner adsorption surface electrode 121 (+150 [V]), and therefore the toner on the developing sleeve 111 is partially adsorbed on the toner adsorption surface electrode 121. Further, as shown by the solid line 901 (FIG. 8), the potential of the toner adsorption surface electrode 121 is reduced due to the negative electric charge of the toner adsorbed on the toner adsorption surface electrode 121. At time t15 (FIG. 8), the potential of the toner adsorption surface electrode 121 is +100 [V].

From time t15 to time t16 (FIG. 8), the potential of the developing sleeve 111 (+300 [V]) is 200 [V] higher than the potential of the toner adsorption surface electrode 121 (+100 [V]), and therefore the toner does not move from the developing sleeve 111 to the toner adsorption surface electrode 121. Therefore, the potential of the toner adsorption surface electrode 121 remains at +100 [V]. From time t16 to time t17 (FIG. 8), the potential of the developing sleeve 111 (−1200 [V]) is 1300 [V] lower than the potential of the toner adsorption surface electrode 121 (+100 [V]), and therefore the toner on the developing sleeve 111 is adsorbed on the toner adsorption surface electrode 121. As shown by the solid line 901 (FIG. 8), the potential of the toner adsorption surface electrode 121 is −50 [V] when the toner is adsorbed thereon.

From time t17 to time t18 (FIG. 8), the potential of the developing sleeve 111 (+300 [V]) is 350 [V] higher than the potential of the toner adsorption surface electrode 121 (−50 [V]), and therefore the toner does not move from the developing sleeve 111 to the toner adsorption surface electrode 121. From time t18 to time t19 (FIG. 8), the potential of the developing sleeve 111 (−1200 [V]) is 1150 [V] lower than the surface potential of the toner adsorption surface electrode 121 (−50 [V]), and therefore the toner on the developing sleeve 111 is adsorbed on the toner adsorption surface electrode 121. As shown by the solid line 901 (FIG. 8), the potential of the toner adsorption surface electrode 121 decreases (to −200 [V]) when the toner is adsorbed thereon. From time t19 to time t20 (FIG. 8), the potential of the developing sleeve 111 (−450 [V]) is 250 [V] lower than the potential of the toner adsorption surface electrode 121 (−200 [V]), and therefore the toner on the developing sleeve 111 is adsorbed on the toner adsorption surface electrode 121. At this time, the amount of toner to be adsorbed on the toner adsorption surface electrode 121 varies on the basis of the potential difference between the potential of the developing sleeve 111 (−450 [V]) and the surface potential of the toner adsorption surface electrode 121 (−200 [V]). That is, as the potential difference increases, the amount of toner that is adsorbed also increases, and as the potential difference is reduced, the amount of toner that is adsorbed also is reduced.

After the toner adsorption potential is supplied to the toner adsorption surface electrode 121, the controller 1107 waits until a pre-determined amount of time has elapsed. The potential of the Q measurement capacitor C1 decreases on the basis of the electric charge of the toner adsorbed on the toner adsorption surface electrode 121. The amount of change in the potential difference corresponds to the charge amount Q of the toner.

In step S1344, the controller 1107 turns off the SW1 and the SW5. This stops the adsorption of toner from the developing sleeve 111 onto the toner adsorption surface electrode 121. At this time, the Q measurement capacitor C1 is disconnected from the toner adsorption surface electrode 121, and therefore the potential of the Q measurement capacitor C1 that has changed due to the adsorption of toner is retained.

Measurement of Q and M after Adsorption of Toner

Figure 6:
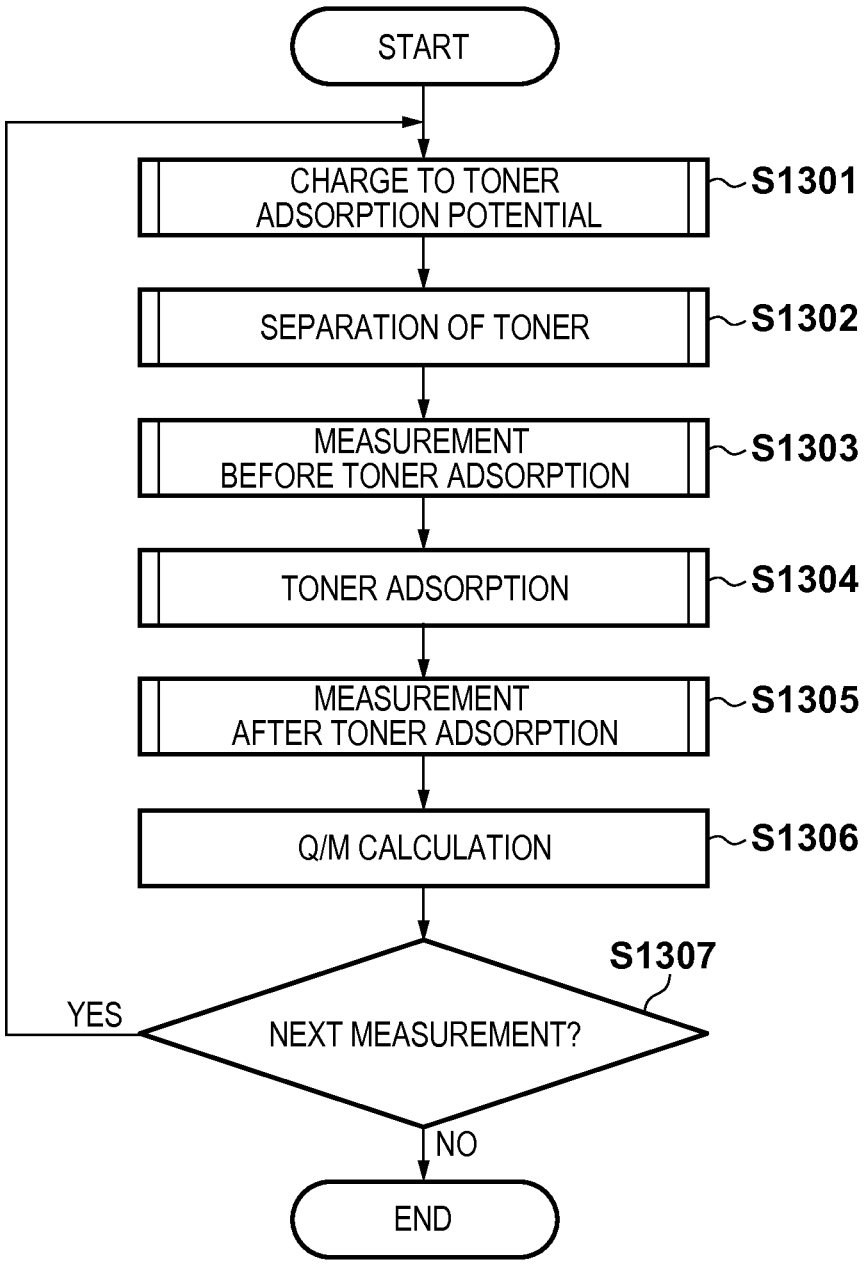
FIG. 6 is a flowchart showing overall operations for Q/M measurement.

When the toner is adsorbed on the toner adsorption surface electrode 121, the controller 1107 executes a charge amount measurement sequence (step S1305) in the toner-adsorbed state as mentioned in the toner charge amount measurement sequence (FIG. 6). That is, the controller 1107 measures the potential V2 of the Q measurement capacitor C1 in the toner-adsorbed state, and the resonance frequency f2 of the quartz piece 127 in the toner-adsorbed state. In this regard, the developing bias has a pulse period and a blank period, and therefore the potential V2 of the Q measurement capacitor C1 and the resonance frequency f2 are measured during the period from time t21 to time t22 (FIG. 8).

Figure 11:
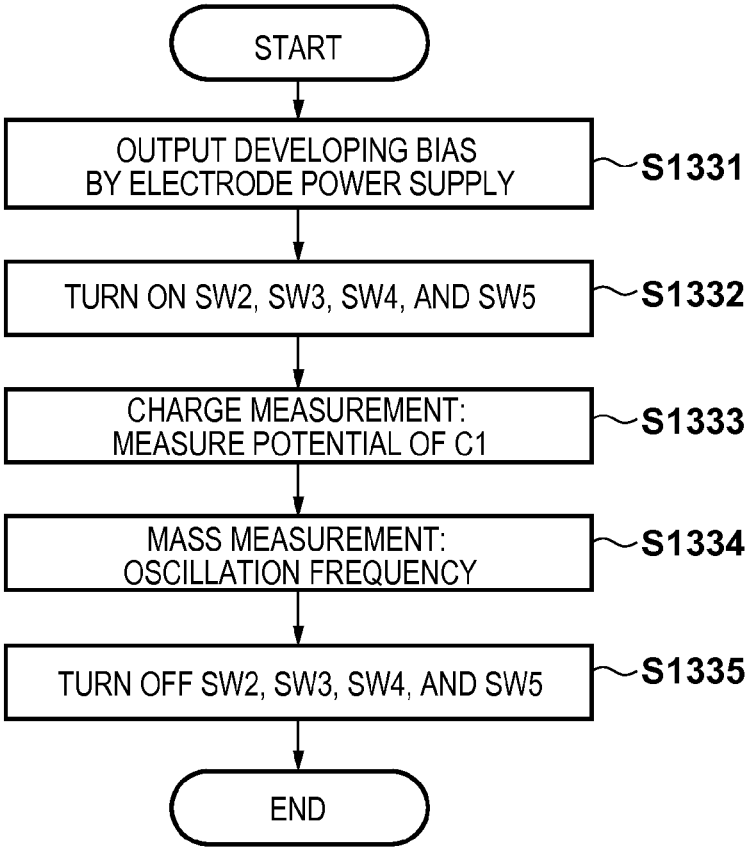
FIG. 11 is a flowchart for measurement of Q and M in Q/M measurement.

The measurement sequence of the potential difference V2 and the resonance frequency f2 in the toner-adsorbed state is performed in the same manner as the measurement sequence before the toner adsorption shown in FIG. 11, and therefore the description thereof is omitted herein.

Calculation of Charge Amount Q

The charge amount calculation unit 1232 calculates the charge amount Q of toner adsorbed on the toner adsorption surface electrode 121, on the basis of the potential V1 measured before the toner adsorption and the potential V2 measured in the toner-adsorbed state. The charge amount Q can be calculated by Formula 1 when the potential measured before the toner adsorption is V1, the potential measured in the toner-adsorbed state is V2, and the capacitance value of the Q measurement capacitor C1 is C:

$$Q=C\times(V1-V2) \quad \text{(Formula 1).}$$

Calculation of Mass M

The mass calculation unit 1235 calculates the mass M of toner adsorbed on the toner adsorption surface electrode 121, on the basis of the resonance frequency f1 measured before the toner adsorption and the resonance frequency f2 measured in the toner-adsorbed state. The mass M can be calculated by Formula 2 when the area of the toner adsorption surface electrode 121 is A, the shear stress of the quartz piece 127 is μ, and the specific gravity of the quartz piece 127 is p:

$$M=-\frac{(f_2-f_1)\times A\sqrt{(\mu\times p)}}{2f_1^2}. \quad \text{(Formula 2)}$$

Calculation of Q/M

The Q/M calculation unit 1106 calculates the charge amount Q/M on the basis of the charge amount Q measured in the Q measurement circuit 1102 and the mass M measured in the M measurement circuit 1103. The toner charge amount Q/M is computed immediately after the completion of the calculation of the charge amount Q and the mass M and not before t22 shown in the timing chart of FIG. 8.

The toner charge amount Q/M can be calculated by Formula 3:

$$Q/M=(\text{measured } Q)/(\text{measured } M) \quad \text{(Formula 3).}$$

Using the sequence as described above, the charge amount Q/M of toner adsorbed on the toner adsorption surface electrode 121 is measured. Further, as shown in FIG. 8, the amount of time required for one instance of measurement is the period from t1 to t23 (for example, 3.5 ms), which is an amount of time that is sufficiently shorter than the amount of time required for printing one sheet. Therefore, it is sufficiently possible to repeatedly execute the toner charge amount measurement sequence a plurality of times while printing images.

Correction of LUT

In this embodiment, the CPU 606 determines whether or not the toner charge amount Q/M measured in the toner charge amount measurement sequence falls within a predetermined numerical range stored in advance. If the toner charge amount Q/M does not fall within the predetermined numerical range, the CPU 606 corrects the LUT 601 using the LUT correction unit 602. Thus, the LUT 601 is updated so that the LUT 601 is appropriate for the current charge amount Q/M. Hereinafter, an update process for updating the LUT 601 will be described.

Figure 13A:
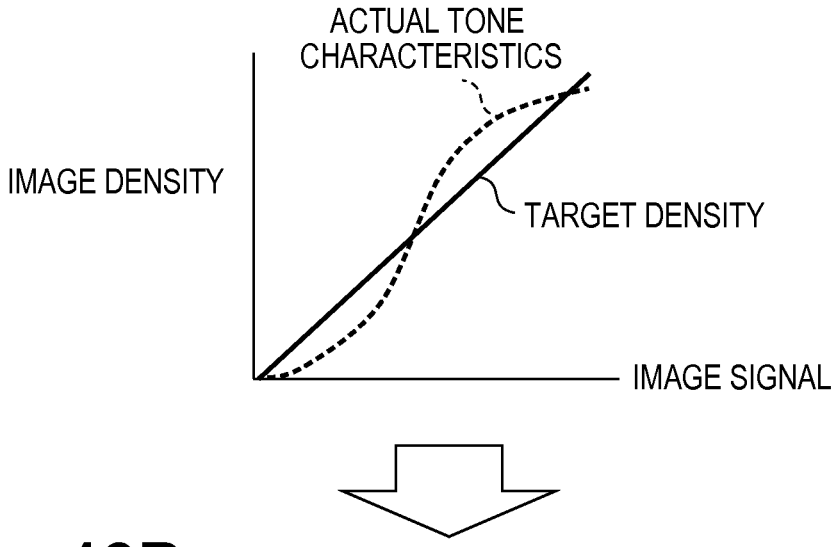
FIGS. 13A and 13B are graphs for describing a γLUT.
Figure 13B:
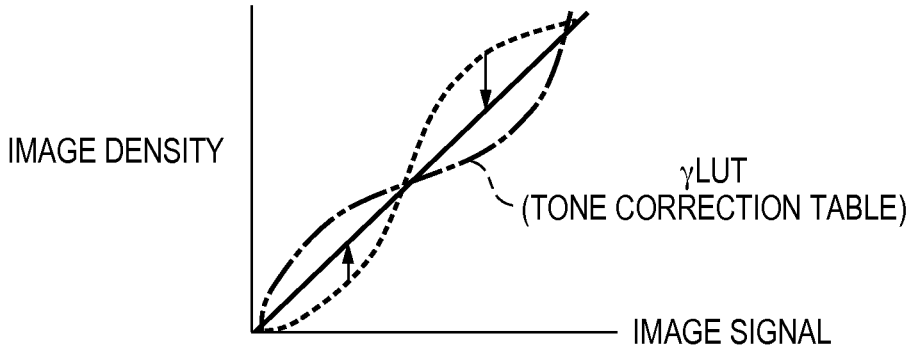

First, a γLUT is described. FIGS. 13A and 13B are graphs showing the relationship between the image signal and the image density. The image forming apparatus of this example has specific tone characteristics, and images formed on the basis of input image data may possibly fail to have a desired density (hereinafter, referred to as "target density"). As an example of the relationship between the image signal and the image density, a case of the relationship shown as "actual tone characteristics" in FIG. 13A is described below. It should be noted that the image signal is a signal indicating a density value for each pixel contained in the image data.

It is desired that the tone characteristics of the image forming apparatus, such as density or brightness of an output image, are linear with respect to the input image signal. However, the tone characteristics that are specific to the image forming apparatus are not necessarily plotted linearly. Therefore, the controller 1107 swaps the X axis and the Y axis of the "actual tone characteristics" in FIG. 13A and creates a tone correction table "γLUT" for correcting the correlative relationship between the image signal and the image density, in order to obtain the desired tone characteristics (for example, see the dashed-dotted line in FIG. 13B).

The γLUT is created by the following steps. The controller 1107 forms a patch image with a different tone on the photoreceptor drum 101, on the basis of a plurality of pre-set image signals. The density of the patch image is detected by an optical sensor 607 (FIG. 1). The controller 1107 obtains a correlation between the image signal of the patch image and the density of the patch image as a detection result, that is, tone characteristics. The controller 1107 creates the γLUT on the basis of the obtained tone characteristics. In order to create the γLUT, it is necessary to output patch images of a plurality of tones, and thus it is difficult to create the γLUT in a short time. Therefore, this example employs the tone correction control to correct the γLUT in a short amount of time, such as printing time.

In this example, the LUT 601 is the reference γLUT that is stored in advance. The γLUT is updated at a timing, for example, immediately after the image forming apparatus is activated, after a certain number of sheets are printed, or when there is a possibility of a significant change in the tone.

Figure 14:
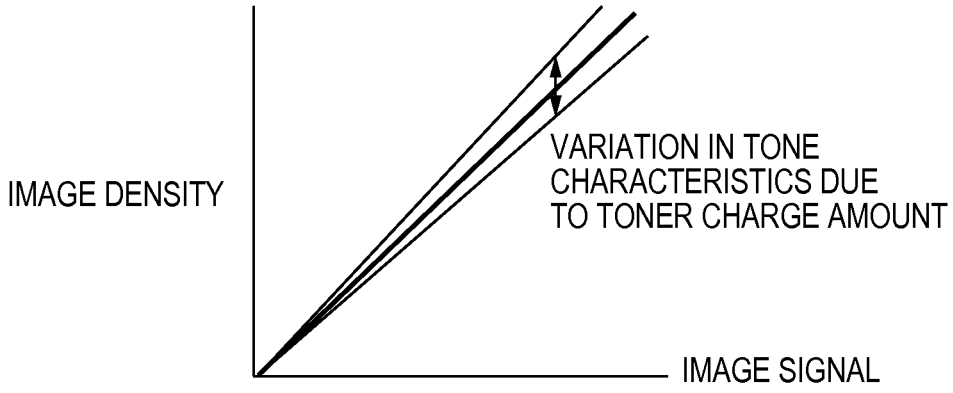
FIG. 14 is a graph for describing a variation in tone characteristics caused by a variation in toner charge amount.

FIG. 14 shows a schematic diagram of a variation in tone characteristics due to the toner charge amount. In this regard, the longitudinal axis indicates the image density, and the horizontal axis indicates the image signal. The image density corresponding to the image signal exhibits behavior as shown in FIG. 14 in response to changes in the toner charge amount. Accordingly, in this example, the controller 1107 corrects the γLUT in the tone correction control, on the basis of the variation amount ΔQ/M in the toner charge amount. For example, it corrects the γLUT by multiplying the γLUT by the toner charge amount correction coefficient k. The correction coefficient k can be determined by Formula 4 below:

$$k=(Q/M)/(Q/M_{ref}) \quad \text{(Formula 4).}$$

Correction of γLUT

Figure 15:
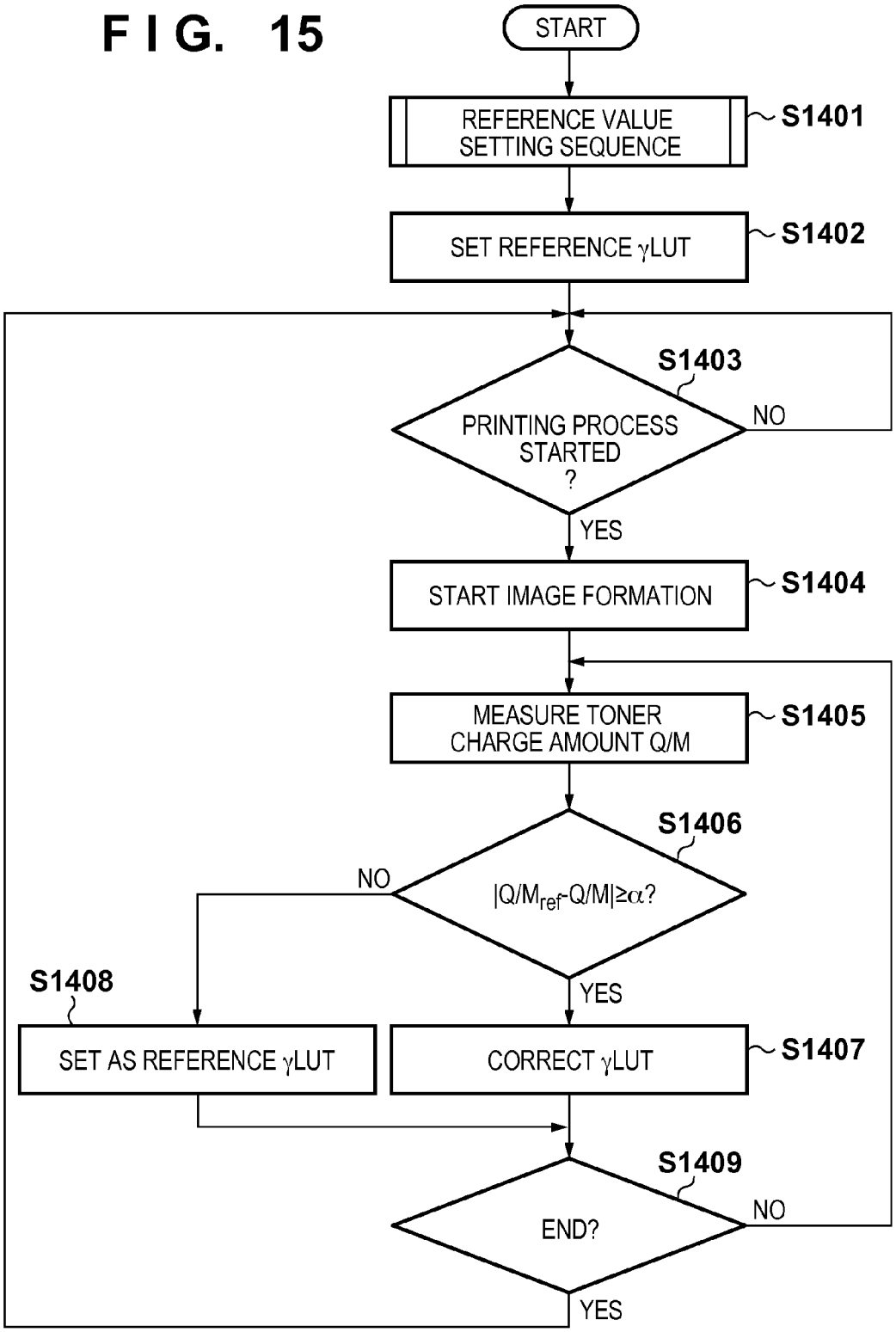
FIG. 15 is a flowchart for correction of a LUT.

Next, the correction of the γLUT will be described in detail with reference to FIG. 15. This process flow is carried out by the LUT correction unit 602.

In step S1401, the LUT correction unit 602 sets a reference value. This step will be described in detail with reference to FIG. 16. In step S1402, the LUT correction unit 602 sets the γLUT determined in step S1401 as a reference γLUT. In step S1403, the LUT correction unit 602 determines whether or not printing has started. If printing has started (YES in step S1403), the process proceeds to step S1404. If printing has not started (NO in step S1403), the procedure waits until printing is started.

In step S1404, the LUT correction unit 602 starts image formation. In step S1405, the LUT correction unit 602 measures the toner charge amount Q/M using the aforementioned method during the image formation. In step S1406, the LUT correction unit 602 determines whether or not the difference between $Q/M_{ref}$, which is a reference value for the toner charge amount, and the Q/M measured in step S1405 is greater than or equal to a threshold α. Here, as shown in FIG. 14, the threshold α is defined according to the variation in the relationship between the image density and the image signal caused by the variation in tone characteristics due to the toner charge amount. If the difference is greater than or equal to the threshold α (YES in step S1408), the process proceeds to step S1407. If it is less than the threshold (NO in step S1406), the process proceeds to step S1408.

In step S1407, the LUT correction unit 602 corrects the γLUT that is currently set. As described above, the γLUT is corrected using the correction coefficient k that is obtained by Formula 4. Then, the process proceeds to step S1409. In step S1408, the LUT correction unit 602 makes a setting indicating that the reference γLUT is to be used without correction. Then, the process proceeds to step S1409. In step S1409, the LUT correction unit 602 determines whether or not the correction process is complete. The determination of completion can be made, for example, on the basis of the fact that the toner charge amount Q/M falls within a predetermined numerical range, or the fact that the process has been repeated a predetermined number of times. If the correction process is complete (YES in step S1409), the process proceeds to step S1403 and waits until the next printing is performed. If the correction process is not complete (NO in step S1409), the process proceeds to step S1405, the toner charge amount Q/M is measured again, and the γLUT is repeatedly corrected on the basis of the variation thereof.

Reference Value Setting Sequence

Figure 16:
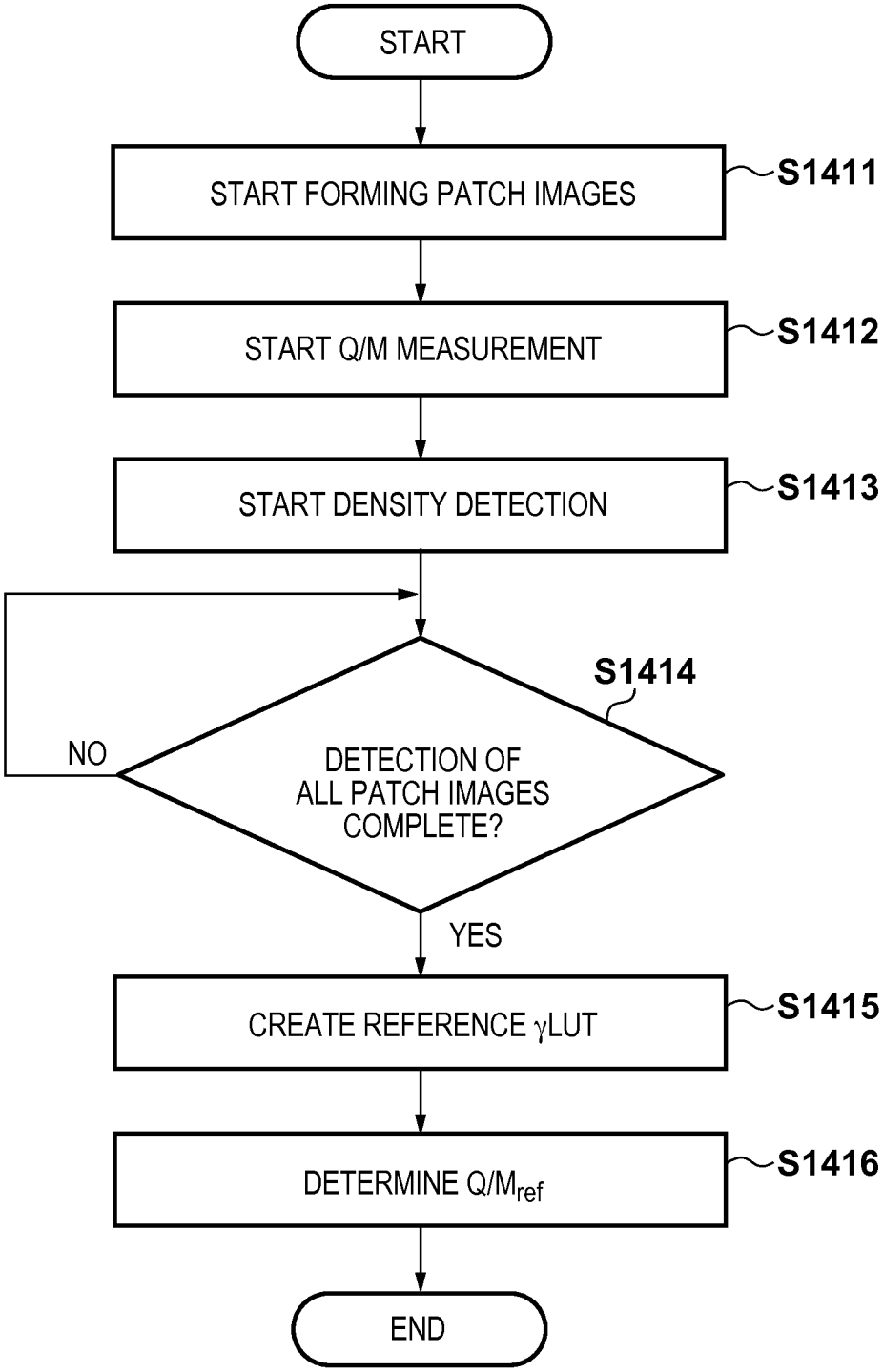
FIG. 16 is a flowchart for setting a reference value.

A detailed flow of a reference value setting sequence of step S1401 in FIG. 15 will be described with reference to FIG. 16.

In step S1411, the LUT correction unit 602 starts an operation for forming a pre-defined patch image on the photoreceptor drum 101. As described above, it is assumed here that a plurality of patches are to be formed. In step S1412, the LUT correction unit 602 starts measuring the toner charge amount at the time of forming the patch images. In step S1413, the LUT correction unit 602 starts detecting the densities of the patch images using the optical sensor 607. In step S1414, the LUT correction unit 602 determines whether or not the densities of all the patch images that were formed have been detected. If the densities of all the patch images that were formed have been detected (YES in step S1414), the process proceeds to step S1415, and if the detection is not complete (NO in step S1414), the process waits until the detection of the patch images is complete.

In step S1415, the LUT correction unit 602 creates the γLUT on the basis of the detected densities of the patch images and the output signals thereof, and sets it as a reference γLUT. In step S1416, the LUT correction unit 602 determines a reference toner charge amount $Q/M_{ref}$ based on the toner charge amount measured at the time of forming the patch images. Thereafter, the present process flow ends.

As has been described above, by using the QCM quartz sensor according to the present invention, toner whose mass is to be detected is prevented from sliding laterally due to the vibration of QCM. The toner and the QCM quartz sensor are integrally vibrated, thereby allowing accurate measurement of the amount of toner used for image formation.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-218673, filed Oct. 21, 2013, which is hereby incorporated by reference herein in its entirety.

What is claimed is:

1. A detection device configured to detect a charge amount of toner on a developer carrier, comprising:

an assembly including a quartz oscillator and having a first surface and a second surface that are provided in the quartz oscillator, the first surface having a recess and a projection formed in a direction in which the quartz oscillator vibrates;

a capacitor connected to the assembly;

a first measurement unit configured to measure a potential difference between two ends of the capacitor; and a second measurement unit configured to measure a frequency of the quartz oscillator, wherein in a case where an alternating-current power is applied to the assembly, the direction in which the quartz oscillator vibrates is parallel to the first surface.

2. The detection device according to claim 1, wherein the first surface has a plurality of recesses and a plurality of projections formed in the direction in which the quartz oscillator vibrates.

3. The detection device according to claim 1, wherein the recess has a longitudinal direction that is different from the direction in which the quartz oscillator vibrates.

4. The detection device according to claim 3, wherein the recess has a longitudinal direction that is orthogonal to the direction in which the quartz oscillator vibrates.

5. The detection device according to claim 1, wherein the recess has a V-shape.

6. The detection device according to claim 1, wherein the recess has a depth that is larger than an average particle size of the toner.

7. A developing device comprising:

a development unit including a developer carrier, the development unit being configured to form a toner image by developing an electrostatic latent image formed on a photoreceptor using toner carried by the developer carrier; and the detection device set forth in claim 1.

8. An image forming apparatus comprising:

a photoreceptor;

an exposure unit configured to expose the photoreceptor so as to form an electrostatic latent image;

a development unit including a developer carrier that carries toner, the development unit being configured to form a toner image by developing the electrostatic latent image;

an assembly including a quartz oscillator and having a first surface and a second surface that are provided in the quartz oscillator, the first surface having a recess and a projection formed in a direction in which the quartz oscillator vibrates;

a capacitor connected to the assembly;

a first measurement unit configured to measure a potential difference between two ends of the capacitor;

a second measurement unit configured to measure a frequency of the quartz oscillator, and a determination unit configured to determine a charge amount of toner on the first surface, on the basis of the potential difference measured by the first measurement unit and the frequency measured by the second measurement unit.

9. The image forming apparatus according to claim 8, wherein the first surface has a plurality of recesses and a plurality of projections formed in the direction in which the quartz oscillator vibrates.

10. The image forming apparatus according to claim 8, wherein the recess has a longitudinal direction that is different from the direction in which the quartz oscillator vibrates.

11. The image forming apparatus according to claim 10, wherein the recess has a longitudinal direction that is orthogonal to the direction in which the quartz oscillator vibrates.

12. The image forming apparatus according to claim 8, wherein the recess has a V-shape.

13. The image forming apparatus according to claim 8, wherein the recess has a depth that is larger than an average particle size of the toner.

* * * * *